US007615018B2

(12) United States Patent
Nelson et al.

(10) Patent No.: US 7,615,018 B2
(45) Date of Patent: Nov. 10, 2009

(54) LEG ULCER, LYMPHOEDEMA AND DVT VIBRATORY TREATMENT AND DEVICE

(75) Inventors: Ernest Peter Nelson, Wallasey (GB); Jeanette Rae Nelson, legal representative, Wallasey (GB); Antony John Seaney, Redhill (GB)

(73) Assignee: Vibrant Medical Limited, Sheffield (GB)

( * ) Notice: Subject to any disclaimer, the term of this patent is extended or adjusted under 35 U.S.C. 154(b) by 156 days.

(21) Appl. No.: 10/643,824

(22) Filed: Aug. 18, 2003

(65) Prior Publication Data

US 2004/0077978 A1 Apr. 22, 2004
US 2009/0234258 A9 Sep. 17, 2009

Related U.S. Application Data

(63) Continuation of application No. PCT/GB02/00705, filed on Feb. 19, 2002.

(30) Foreign Application Priority Data

Feb. 19, 2001 (GB) ..... 0103893.4
Aug. 1, 2001 (GB) ..... 0119120.4

(51) Int. Cl.
*A61H 23/02* (2006.01)

(52) U.S. Cl. ..... 601/57; 601/70

(58) Field of Classification Search ..... 601/23, 601/26, 27–31, 46, 49, 56–59, 61, 69, 70, 601/71, 79; 128/898
See application file for complete search history.

(56) References Cited

U.S. PATENT DOCUMENTS 2,917,043 A 12/1959 Murphy (Continued)

FOREIGN PATENT DOCUMENTS

EP 0373912 6/1990

(Continued)

OTHER PUBLICATIONS

Lievens, Leduc, Dewald, "The Use of Cycloidal Vibrations Therapy on Blood and Lymph Circulation and on Wound Healing," VII International Congress of Lymphology, Oct. 28, 1979 to Nov. 2, 1979, Firenze, Italy.

(Continued)

*Primary Examiner*—Steven O Douglas
(74) *Attorney, Agent, or Firm*—Keeling Patents & Trademarks, LLC; Kenneth A. Keeling; Melissa M. Martinez

(57) ABSTRACT

An ulcer, lymphoedema and DVT treatment device (10) comprises a drive unit (12) adapted to deliver mechanical vibrations at its surface in three orthogonal directions at a frequency in each orthogonal direction of between 15 and 75 Hz and with an amplitude in each orthogonal direction of between 0.1 and 0.5 mm. A pad (110) is connected to the drive unit, and a strap (46) enables the pad to be pressed against the limb of the animal or human. The motor drives an eccentrically mounted weight (22) to provide oscillations of the casing in a radial plane. The device is employed to treat a patient suffering from leg ulcers, lymphoedema and DVT by applying three-dimensional vibrations. A cover (150) is provided to protect the pad (110) from contamination.

22 Claims, 23 Drawing Sheets

U.S. PATENT DOCUMENTS

| | | | | |
|---|---|---|---|---|
| 3,019,785 | A | 2/1962 | Eiden | |
| 3,853,121 | A | 12/1974 | Mizrachy et al. | |
| 5,329,934 | A | 7/1994 | Bowman | |
| 5,606,754 | A | 3/1997 | Hand et al. | |
| 5,948,009 | A | 9/1999 | Tu | |
| 6,086,550 | A | 7/2000 | Richardson | |
| 6,178,577 | B1 | 1/2001 | Chien-Chuan | |
| 6,620,117 | B1 * | 9/2003 | Johnson et al. | 601/90 |

FOREIGN PATENT DOCUMENTS

| | | |
|---|---|---|
| GB | 2096899 | 10/1982 |

OTHER PUBLICATIONS

Pickup, Alexander, Gosling, "The effect of cycloid vibration on leg blood flow and ulcer pain," Section of Dermatology of the Royal Society of Medicine, 1978.

Pickup, Alexander, Gosling, "The Effect of cycloid Vibration on Leg Blood Flow and Ulcer Pain," Section of Dermatology of the Royal Society of Medicine, 1978.

Ramcharan, Shoja, Piggott, Taylor, "The Effects of Vibration Upon Blood-Viscosity and Red-Cell Mobility: A Study In Vivo and In-Vitro," Biorheology, 1982, vol. 19, Pergamon Press Ltd., USA.

Ryan, Salter, "The Effects of Vibration on Skin and Blood Flow," Biblotheca Anatomica, 1977, vol. 16 S. Karger, Basel, Switzerland.

Askari, Rozov, "Improvement of Blood Flow in Ischaemic Limbs by the Use of Cycloid Therapy," Israel.

* cited by examiner

LEG ULCER, LYMPHOEDEMA AND DVT VIBRATORY TREATMENT AND DEVICE

CROSS-REFERENCE TO RELATED APPLICATIONS

This application claims the benefit of International Application number PCT/GB02/00705, filed on Feb. 19, 2002, which claims the benefit of foreign application GB 0103893.4, filed in Great Britain on Feb. 19, 2001 and also claims the benefit of GB 0119120.4, filed in Great Britain on Aug. 1, 2001.

STATEMENT REGARDING FEDERALLY SPONSERED RESEARCH OR DEVELOPMENT

Not applicable.

BACKGROUND OF THE INVENTION

1. Field of the Invention

The present invention relates to a vibratory massage device for the treatment of open sore ulcers, lymphoedema and deep vein thrombosis (DVT) as they affect the human or animal body, and a method of treatment of open sore ulcers, lymphoedema and deep vein thrombosis (DVT).

2. Description of the Related Art

It is well understood that three-dimensional vibration (referred to as cycloidal vibration) has beneficial effects in improving blood circulation, joint mobility, and respiratory conditions, and relieving tension. Such vibration is in the frequency range of 15 to 75 Hz with an amplitude varying between 0.1 and 0.5 mm, depending on the orthogonal direction.

Decubitus ulcers are caused by continuous pressure at specific points of the body when a patient is immobile for extended periods of time. It is known that vibration can assist in preventing the development of such sores and U.S. Pat. No. 5,606,754 suggests a bed which has vibration means to reduce the incidence of bed sores.

Ulcers are caused by underlying blood circulatory problems, either venous or arterial disease. If the venous system in the leg fails to work normally, the pressure in the leg veins rises. This reduces circulation in the lower leg and leads to swelling and discomfort. The skin changes and becomes vulnerable and is poor at healing. A small injury, bite or minor infection, that would normally heal quickly, instead progresses and an area of skin break down results in the formation of an ulcer. Varicose veins, a previous deep vein thrombosis, or primary failure of the valves in the veins can all contribute to ulcers.

The current method of treatment is to cover the affected skin area with a dressing, in order to keep the skin moist and prevent infection from entering the sore, and to immobilise the sore in order to facilitate healing. However, some patients suffer from venous ulcers for extended periods of time in the order of months or even years before they heal, if ever. There is an evident need for more efficient treatment of ulcers.

U.S. Pat. No. 5,948,009 discloses an ablation electrode for treating canker sore in which vibratory massage is applied to create a lesion. This is said to create the conditions for subsequent healing.

Lymphoedema is the chronic swelling of subcutaneous tissues due to the accumulation of excessive lymph fluid. The accumulation of lymph fluid results from impairment to the normal clearing function of the lymphatic system and/or from an excessive production of lymph. Lymphoedema is divided into two broad classes according to aetiology. Primary lymphoedema is a relatively uncommon, chronic condition which may be due to such causes as Milroy's Disease or congenital anomalies. Secondary lymphoedema, which is much more common, results from the destruction of, or damage to, formerly functioning lymphatic channels, such as surgical removal of lymph nodes or post radiation fibrosis, among other causes.

Current common treatments include manual lymphatic drainage (a form of skin massage), exercise program and a form of compression bandaging. However, pneumatic compression therapy is also used, although proof of its effectiveness is lacking. Indeed, care needs to be taken to avoid forcing fluid too rapidly from the limb to adjacent parts of the body.

Deep Vein Thrombosis (DVT) refers to the formation of a thrombus (blood clot) within a deep vein, commonly in the thigh or calf. The blood clot can either partially or completely block the flow of blood in the vein.

Compression therapy is used to aid circulation to prevent patients at risk of clotting from developing DVT. Likewise, pneumatic compression therapy is used on patients at risk of DVT and this treatment is often used prior too and after surgery, especially limb surgery such as knee surgery and joint replacement where the risk of DVT is often greater.

P Lievens, A Leduc and J Dewald presented a paper under the title "The Use of Cycloidal Vibrations Therapy on Blood and Lymph Circulation and on Wound Healing", at the VII International Congress of Lymphology, Firenze, Italy 28 Oct. to 2 Nov. 1979. In that there was a suggestion that some aspects of wound healing in test mice were improved by a regime of cycloidal vibrations. However, nothing has come of that work and its teaching is limited.

Also, A J Pickup, S Alexander, and R G Gosling presented a paper under the title "The effect of cycloid vibration on leg blood flow and ulcer pain" to the Section of Dermatology of the Royal Society of Medicine in 1978. While vibration was recognised to dramatically reduce pain from leg ulcers, only a slight improvement in healing was noticed.

It is an object of the present invention to provide an improved method of treatment of ulcers, and also lymphoedema and deep vein thrombosis.

In accordance with a first aspect of the present invention there is provided a method of treatment of ulcers of the human or animal body, which method comprises the step of subjecting the body in the area of the ulcer to mechanical vibrations for an effective period of time, said vibrations having a frequency of between 15 and 75 Hz, and an amplitude of between 0.1 and 0.5 mm.

In accordance with a second aspect of the present invention there is provided a method of treatment of lymphoedema of a patient, which method comprises the step of subjecting the body in the area of the lymphoedema to mechanical vibrations for an effective period of time, said vibrations having a frequency of between 15 and 75 Hz, and an amplitude of between 0.1 and 0.5 mm.

In accordance with a third aspect of the present invention there is provided a method of prophylactic treatment of deep vein thrombosis, which method comprises the step of subjecting the body in the area of the thrombosis to mechanical vibrations for an effective period of time, said vibrations having a frequency of between 15 and 75 Hz, and an amplitude of between 0.1 and 0.5 mm.

The cycloidal mechanical vibrations are provided by a treatment device that delivers mechanical vibrations at its surface in three orthogonal directions at a frequency in each orthogonal direction of between 0.1 and 0.5 mm. The device may have a pad connected thereto. The step may further comprise the application of pressure against the limb. This pressure may be applied by a pressure applying means so that, in use, the device delivers vibrations in the limb of the patient at a frequency of between 15 and 75 Hz, and with an RMS acceleration in the axial direction of the tibial or fibulal bone of between 5 and 15 $ms^{-2}$, and in a radial plane with respect to the tibial or fibulal bone with an RMS acceleration of between 2 and 5 $ms^{-2}$.

Preferably, said vibrations have, in each case, components in three orthogonal directions, said frequency being the same or different in each direction, and said amplitude being the same or different in each direction. Preferably said period is more than fifteen minutes, ideally about thirty minutes. The treatment is preferably repeated three times a day.

Preferably, said treatment is applied by a vibratory device comprising a pad, and said method also involves the application of pressure by the pad against the tissue of the patient. The pad is preferably a cushioned frame fixed to a vibratory drive unit.

In another aspect, the present invention provides an ulcer, lymphoedema and deep vein thrombosis treatment device comprising:

a drive unit adapted to deliver mechanical vibrations at its surface in three orthogonal directions at a frequency in each orthogonal direction of between 15 and 75 Hz and with an amplitude in each orthogonal direction of between 0.1 and 0.5 mm;

a pad connected to said drive unit; and pressure applying means by which the pad may be pressed against the limb of the animal or human.

Preferably, said pressure applying means comprises a strap by means of which the pad may be secured to said limb. Indeed, preferably, the area over which a given level of pressure in excess of 1333 Pa (10 mmHg), preferably 2666 Pa (20 mmHg), is applied to the limb by the pad is increased by at least 25%, preferably 50%, by application of said pressure applying means.

Preferably, the drive unit is substantially cylindrical. It may have a casing mounting a motor having an armature parallel the axis of the cylinder. The motor may drive an eccentrically mounted weight to provide oscillations of the casing in a radial plane. The motor may be mounted through flexible mountings in the casing so that a component of the vibration is created in an axial direction of the armature.

In another aspect, the invention provides the use of a drive unit and a pad in the manufacture of a device for the treatment of an ulcer, lymphoedema or deep vein thrombosis of a patient, wherein said drive unit is adapted to deliver mechanical vibrations at its surface in three orthogonal directions at a frequency in each orthogonal direction of between 15 and 75 Hz and with an amplitude in each orthogonal direction of between 0.1 and 0.5 mm, and wherein said pad is connected to said drive unit.

GB-A-2096899 describes a conventional analogue control of a universal AC motor for a vibration device, which control is found not to provide a smooth delivery of power to the motor so that, at some frequencies, the three-dimensional nature of the vibrations is lost.

Preferably, therefore, the motor is electrically powered from mains AC electricity, the drive unit including digital control means to ensure smooth supply of energy to the motor.

Said digital control means preferably comprises:

a detector for each zero crossing point of the AC power supply and adapted to disconnect power from the motor when said crossing point is detected;

a timer comprising a counter started by said detector;

a comparator to compare the count of said counter with a number stored in a memory and to switch power to the motor when said count equals said number.

Preferably, a low voltage transformer is disposed between the power supply and detector. A rectifier may convert the power supply to the motor to DC, if the motor is a DC motor.

Preferably said number is adjustable to vary the power supplied to the motor, and hence its speed of rotation and hence said frequency.

Preferably said counter is capable of providing about 250 counts in each half cycle of the power supply.

Preferably the drive unit operates at a frequency of between 30 and 60 Hz.

Said pad preferably comprises a rigid frame connected to said drive unit and through which mechanic vibrations are transmitted, and cushioning overlying the frame.

When the method above employs the device provided by the present invention, the pad is applied by said pressure applying means to the leg of a patient suffering from ulcers, lymphoedema or deep vein thrombosis and so that, in use, the device delivers vibrations in the leg of the patient at a frequency of between 20 and 50 Hz, and with an RMS acceleration in the axial direction of the tibial bone of between 5 and 15 $ms^{-2}$, and in a radial plane with respect to the tibial bone with an RMS acceleration of between 2 and 5 $ms^{-2}$. The acronym RMS is well known in mathematics, science, and engineering for the "root mean square."

Preferably, the device delivers vibrations in the leg of the patient at a frequency of about 30 Hz, and with an RMS acceleration, in the axial direction of the tibial bone, of about 10 $ms^{-2}$, and, in a radial plane with respect to the tibial bone, with an RMS acceleration of between 2 and 5 $ms^{-2}$.

Despite the apparent contrary indication that movement will unsettle the healing of venous ulcers, it has been discovered that cycloid vibrations have a beneficial effect on their healing, and that this healing is dramatically improved by the application of pressure against the tissue of the patient by the cushioned pad that is delivering the vibrations. Without being reliant on any particular theory, this beneficial effect may be due to improved blood circulation caused by the vibrations and increased moisture in the upper dermis and epidermis. Indeed, the healing effects of the present invention are especially felt when two features of the invention are fully exploited. The first is the three-dimensional aspect of the vibration; some benefit is experienced with two-dimensional vibration but significantly enhanced effects have been noted with three-dimensional "cycloidal" vibration, particularly when employing the motor control described above which provides smooth power delivery to the motor. The second is the pressure applying means, which serves to unite the patient's limb with the device and ensures deep transmission of the vibrations into the flesh of the patient. This is particularly the case given the cushioned pad, which of course tends to dampen vibration. By pressing the pad against the patient's leg, the area of contact is increased and this enhances the transmission of vibration throughout a greater volume of the patient's tissue. Together with effective motor control limiting the appearance of transient spikes and the pressure applying means spreading the application of the vibrations, more intense vibrational treatment is possible without exceeding the comfort threshold that patients encounter as the intensity of vibration is increased.

Furthermore, the invention also provides a device as described above further comprising a detachable cover for the pad and drive unit. Said cover may comprise an open pouch to receive said pad and drive unit, fastening means to close the pouch about the pad and drive unit, openings in the cover being provided to permit cooling airflow into the drive unit.

Said cover preferably comprises a deep pouch to receive the pad, and a flap on a front side of the pouch extending from the lip thereof and having a first fastener along its edge remote from said front lip and adapted to detachably fasten to a second fastener along the lip of the pouch on its rear side, two of said openings thereby being defined between each free edge of the flap and the lip of the pouch between its front and rear sides respectively.

Preferably, one of said fasteners comprises a strip of hooked material while the other comprises a strip of hooped material, so that pressing said materials together effects a releasable connection.

Preferably, the cover is of impervious material to prevent liquid from penetrating and contaminating a pad received within the cover.

Preferably, a strap is integrally formed in the cover. Indeed, there may be two straps spaced along the pouch so that, if one is in the area of the ulcer of the patient when the patient's limb is located appropriately with respect to the pad, it can be left undone. When the other strap is secured, this applies sufficient pressure to provide the improved vibration transmission.

Preferably, the or each strap is sewn at one end into a side edge of the pouch and at its other end is provided with a third fastener, the other side edge of the pouch being provided with a complimentary fourth fastener.

Preferably, the fourth fastener extends along the length of the pouch to vary the possible disposition of the or each strap when the third and fourth fasteners are engaged.

The third and fourth fasteners may comprise hooped and hooked fabric material. Indeed, the fourth fastener may comprises a strip of such material along a significant part of the length of the side edge of the pouch so that the or each strap can vary in its position of attachment to the other side of the cover.

The cover serves to protect the pad from contamination from weeping and ulcers. Such weeping tends to occur when they are treated in accordance with the present invention.

In another aspect, the cover may comprise a simple sheet of material having means to gather its edges on an underside of the pad of the vibratory device, and render the sheet taught on an operative side of the pad against which a patient's limb is intended to lie. At least one hole is preferably provided in the sheet to permit the drive unit to protrude through.

The cover may comprise means to fasten a strap to the cover, and hence to the pad, for the purpose of providing said pressure applying means. Said strap fastening means may comprise strips of hooked or hooped material along the sides of the cover to which a strap of respectively hooped or hooked material may be fastened.

Indeed, in another aspect, the invention provides a cover for a vibratory massage device as defined herein, the cover being as defined above.

Furthermore, the invention provides a kit of parts, comprising a cover and a strap, and, in its simplest form, this may comprise a simple sheet suitable for protecting the pad, and a strap suitable for applying the requisite pressure when securing a patient's limb to the pad.

BRIEF SUMMARY OF THE INVENTION

An ulcer, lymphoedema and DVT treatment device comprises a drive unit adapted to deliver mechanical vibrations at its surface in three orthogonal directions at a frequency in each orthogonal direction of between 15 and 75 Hz and with an amplitude in each orthogonal direction of between 0.1 and 0.5 mm.

A pad is connected to the drive unit, and a strap enables the pad to be pressed against the limb of the animal or human.

The motor drives an eccentrically mounted weight to provide oscillations of the casing in a radial plane.

The device is employed to treat a patient suffering from leg ulcers, lymphoedema and DVT by applying three-dimensional vibrations. A cover is provided to protect the pad from contamination.

BRIEF DESCRIPTION OF THE DRAWINGS

The invention is further described hereinafter, by way of example, with reference to the accompanying drawings, in which:—

DESCRIPTION OF THE INVENTION

Figure 1:
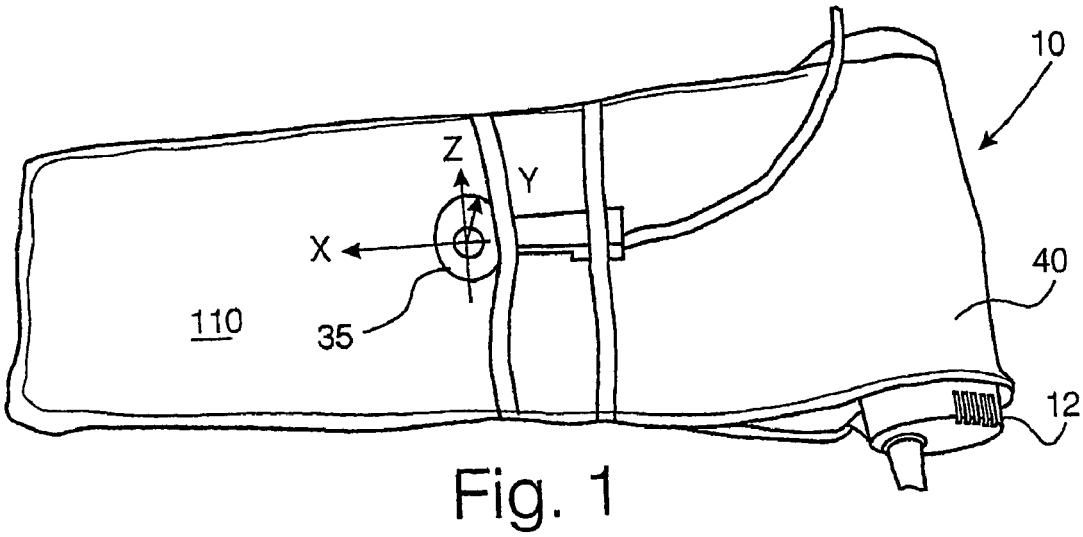
FIG. 1 is a perspective view of a vibratory massage device in accordance with the present invention, (having attached thereto a transducer pack analysing the vibrations of the pad in three orthogonal directions x, y and z)

In the drawings, a vibratory massage device 10 in accordance with the present invention comprises a drive unit 12. The drive unit comprises a casing 14 housing an electric low voltage DC motor 16 mounted in the casing through flexible mountings 18,20. The motor drives an eccentric weight 22 mounted on a fan 23 on each end of an armature 24. On rotation of the armature 24 motor 16 imparts a vibration in the casing 14 in a radial plane (x,y) with respect to the armature 24. Because the mountings 18,20 are soft, a component of the vibration occurs in a direction orthogonal (z) to the radial plane. Consequently, the vibration of the casing in response to the vibration of the motor is three-dimensional.

Figure 6:
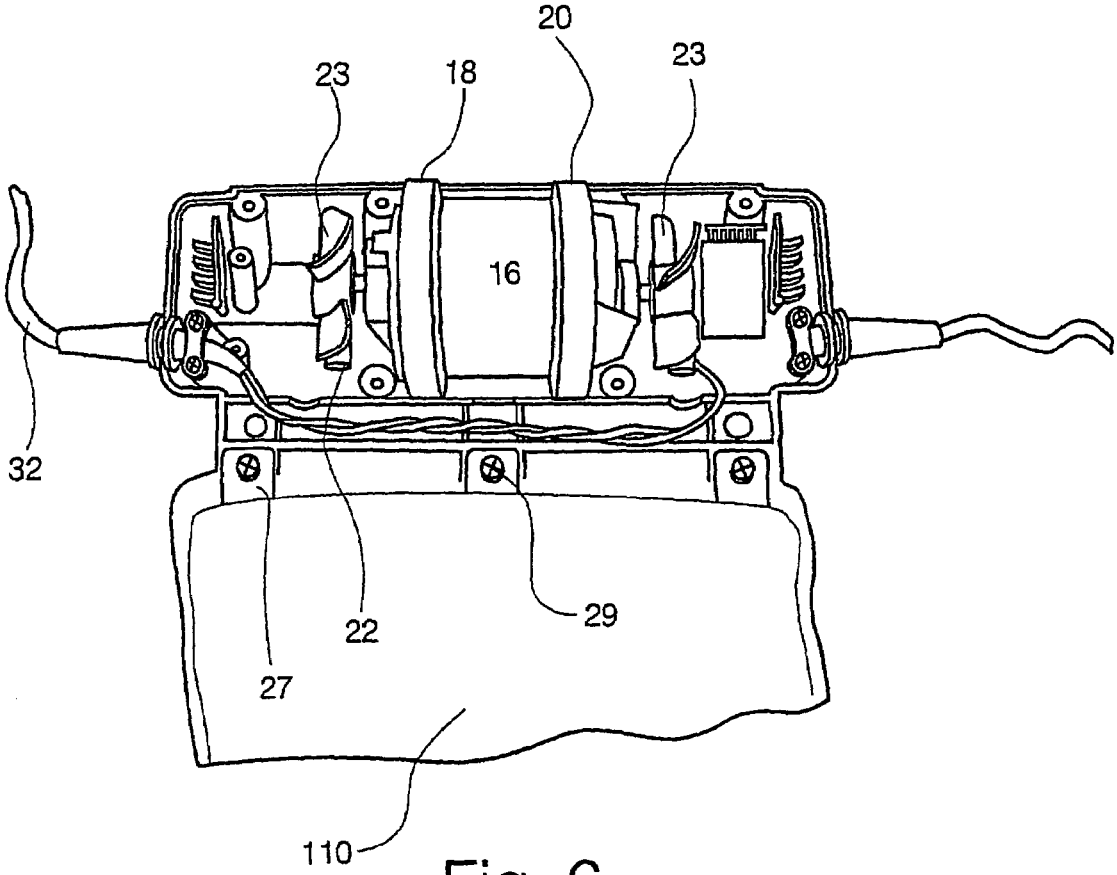
FIG. 6 is a top view of the drive unit with the casing open.

To the casing is fixed, by screws 29 (see FIG. 6) retained in apertures 25 of the casing, a frame 27. On the frame is disposed fabric cushioning to form a pad 110. The cushioning covers the drive unit 12 with a sleeve 40.

The motor is adapted to rotate at about 2400 rpm providing a frequency of vibration of about 40 Hz. Depending on various factors (primarily connected with the degree of restraint placed upon the device by its location on the limb of an animal) the amplitude of vibration in each direction may be different and between about 0.1 mm and 0.5 mm.

Figure 7:
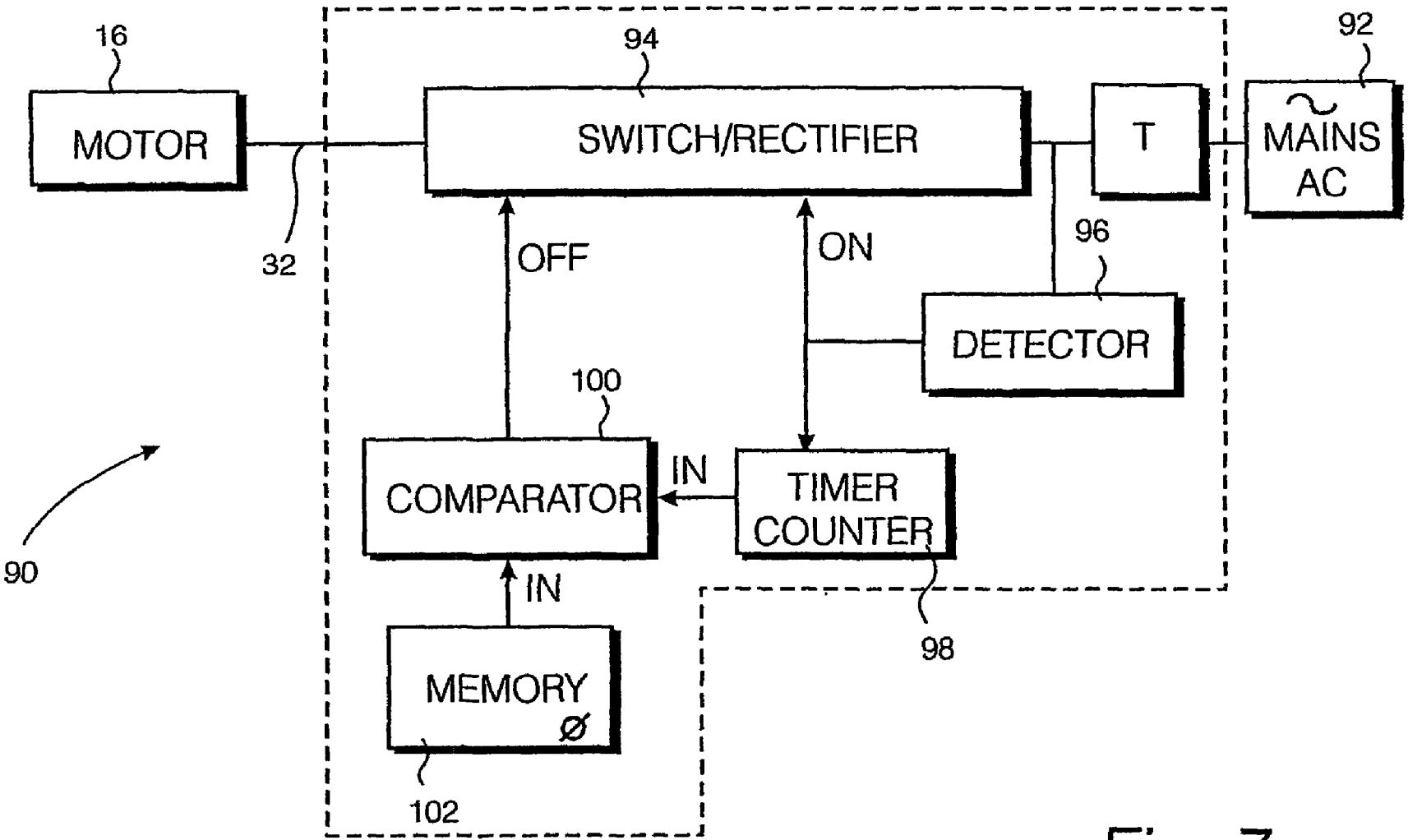
FIG. 7 is a schematic representation of the control function of the motor of the drive unit.
Figure 8A:
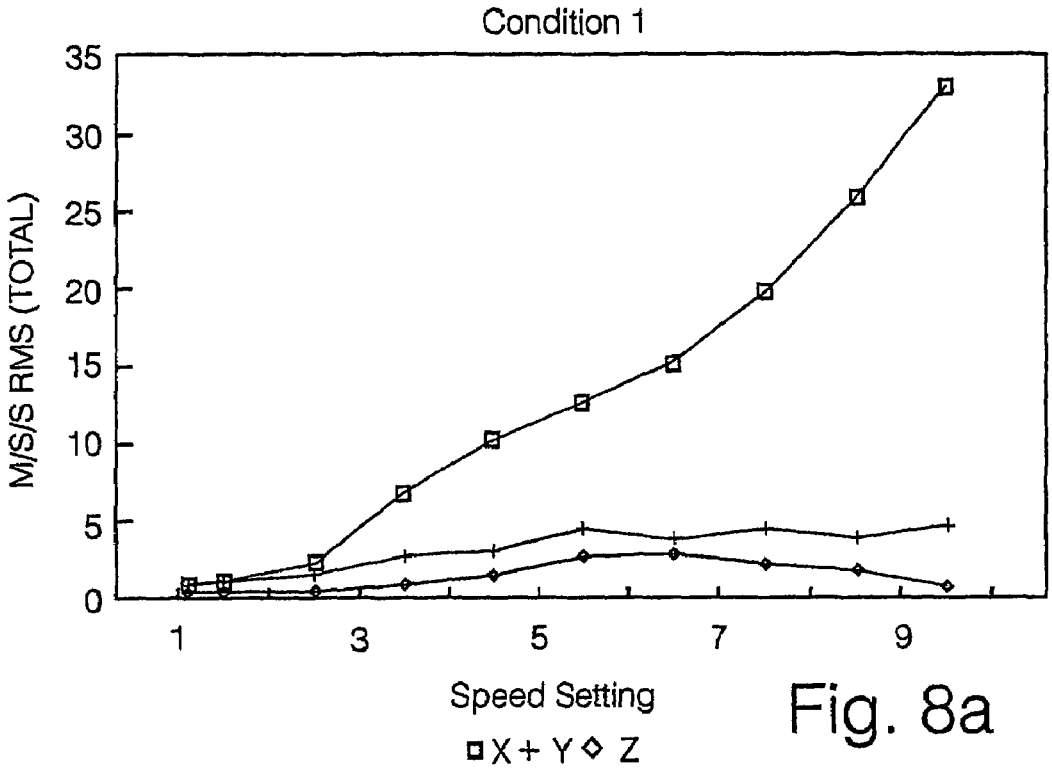
FIGS. 8*a* to *j* are graphs of RMS acceleration of the vibrations produced under varying conditions in the three orthogonal directions x, y and z, as well as the frequency of the vibrations.
Figure 8B:
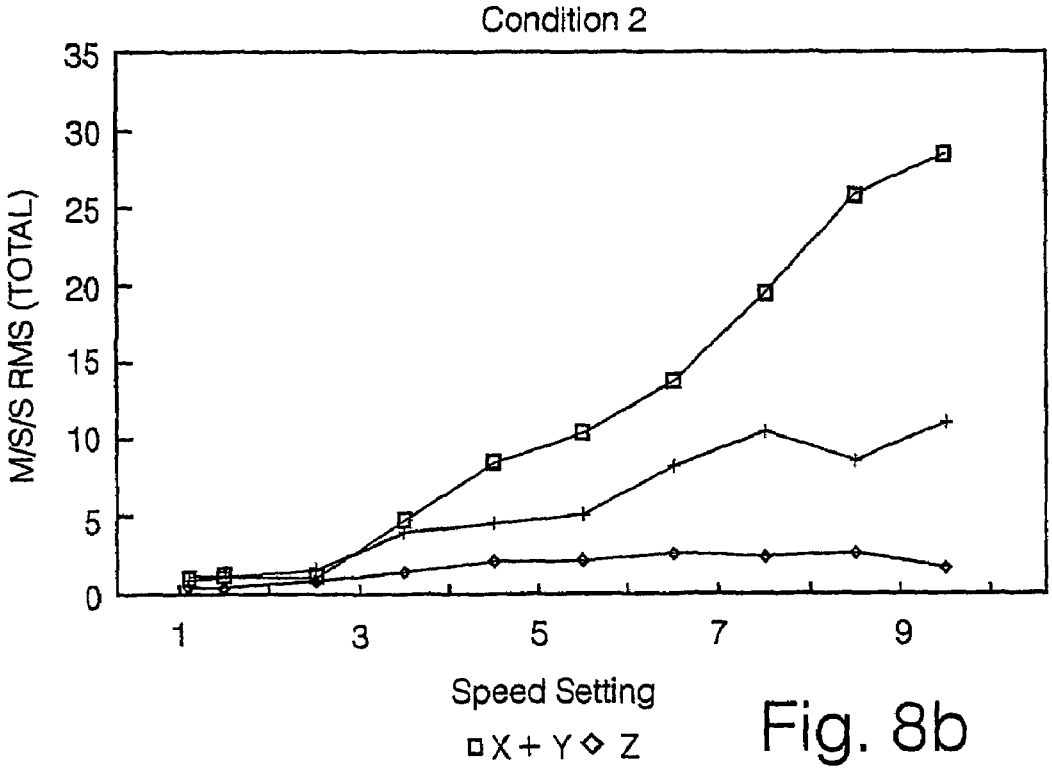
Figure 8C:
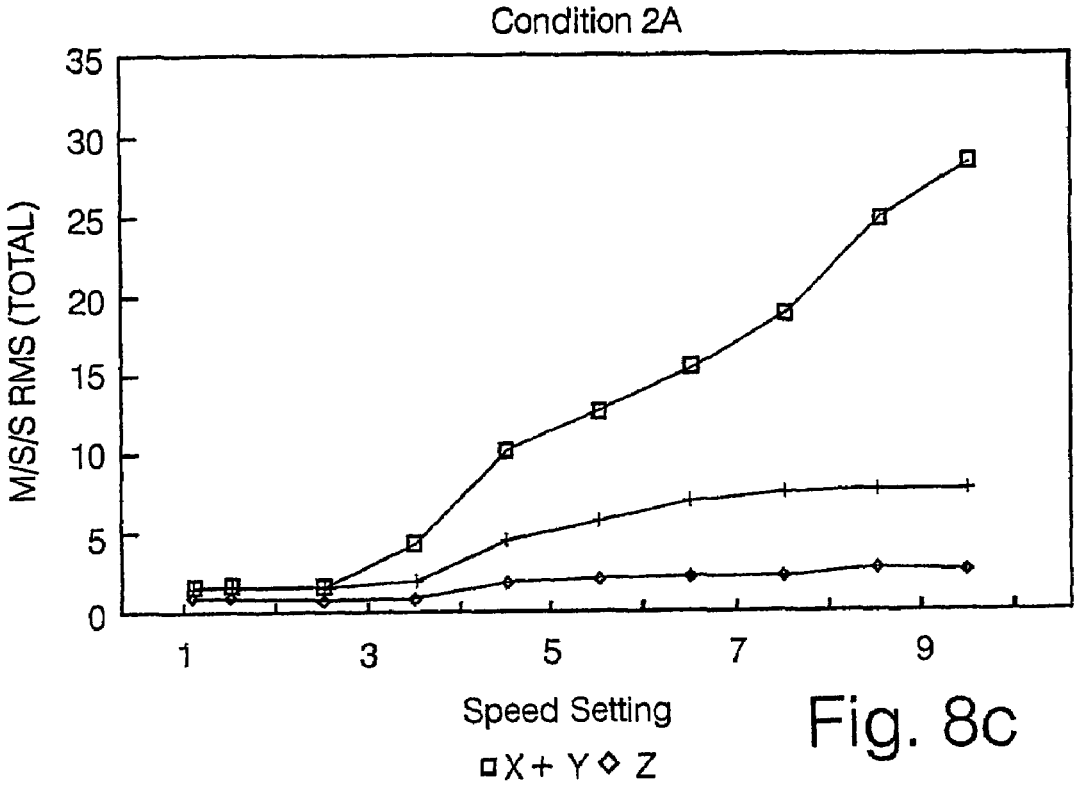
Figure 8D:
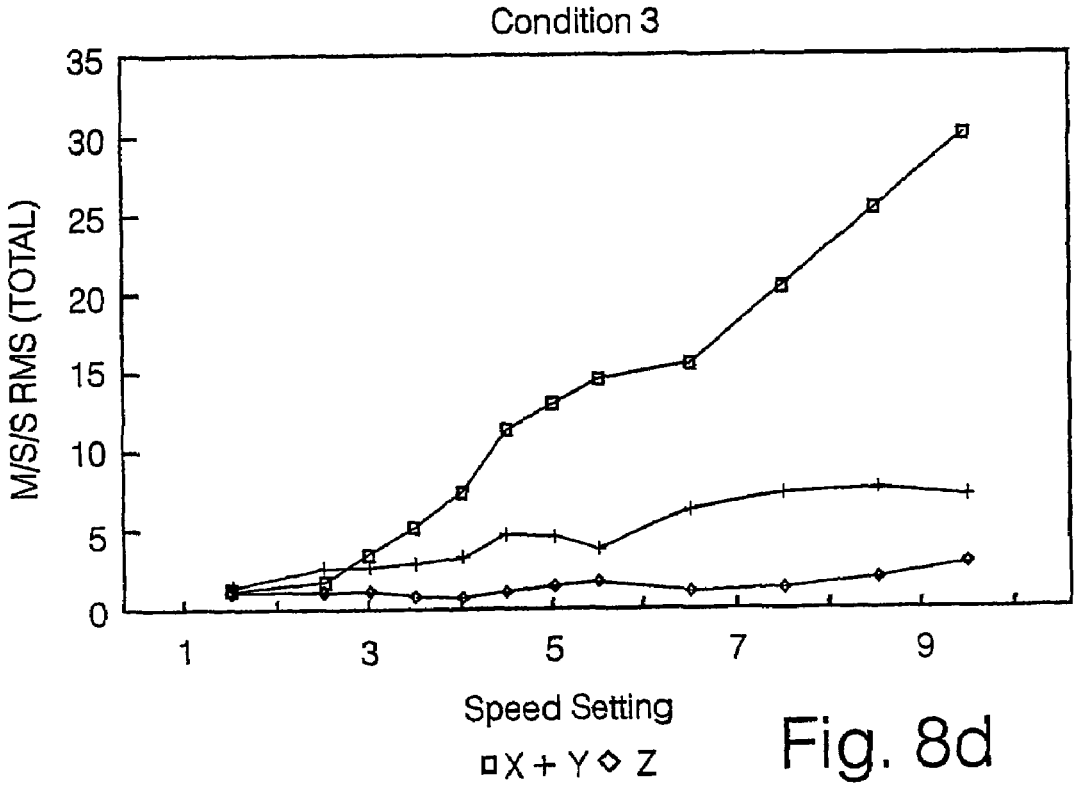
Figure 8E:
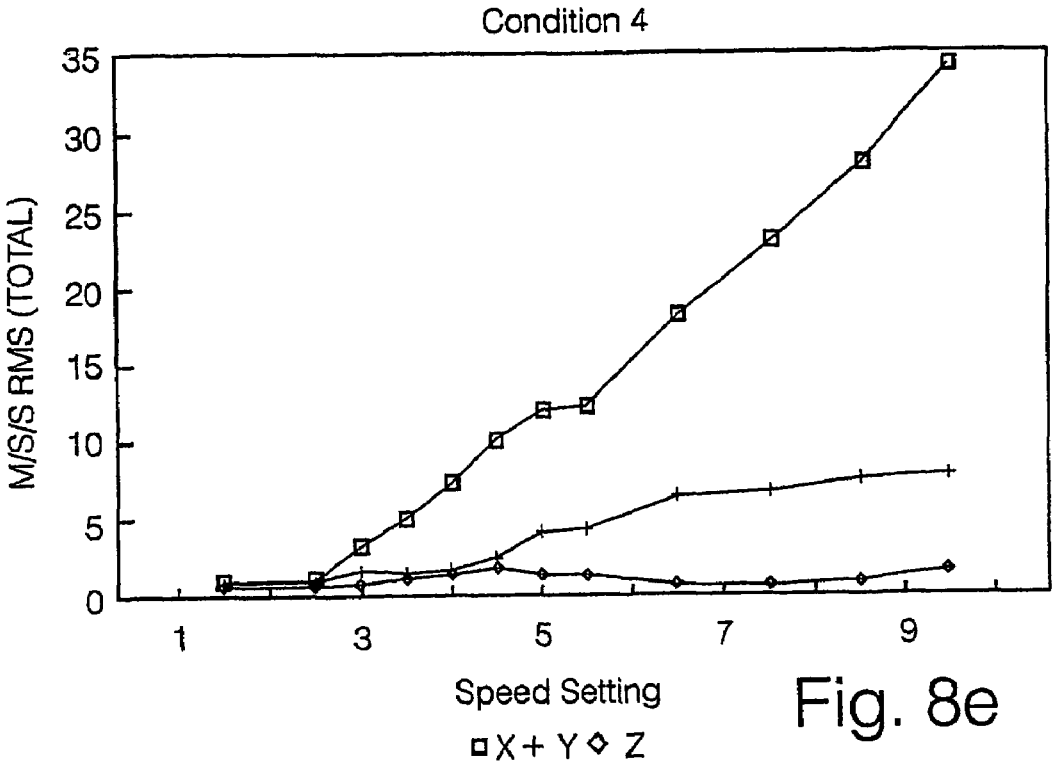
Figure 8F:
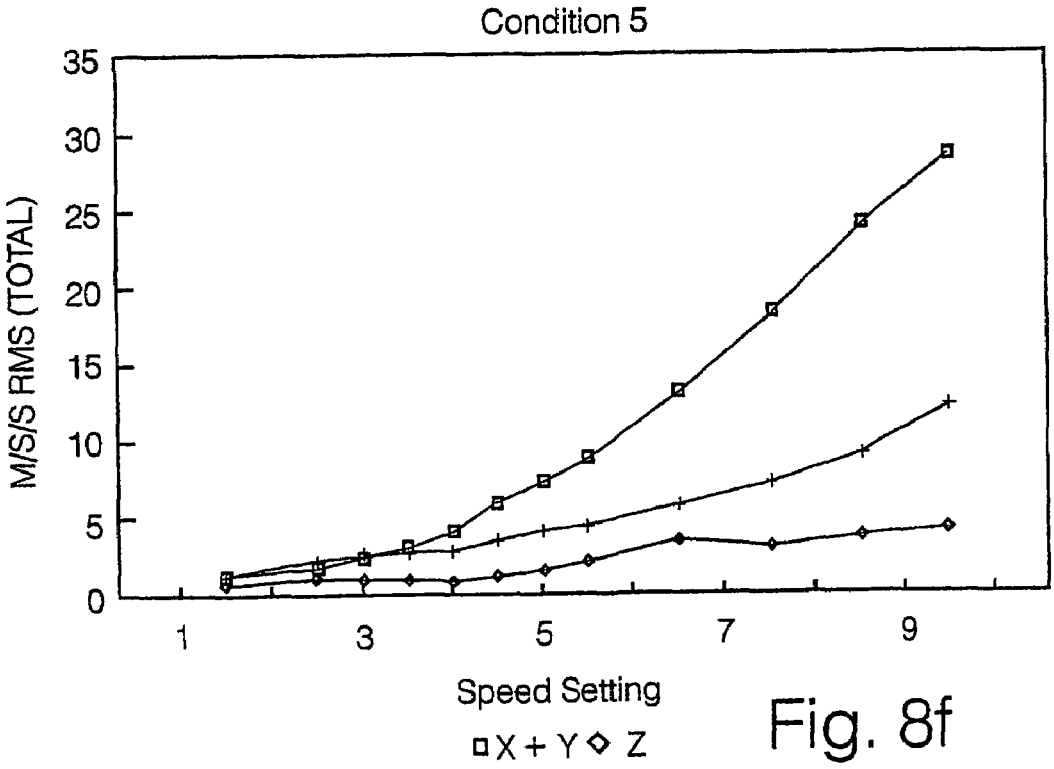
Figure 8G:
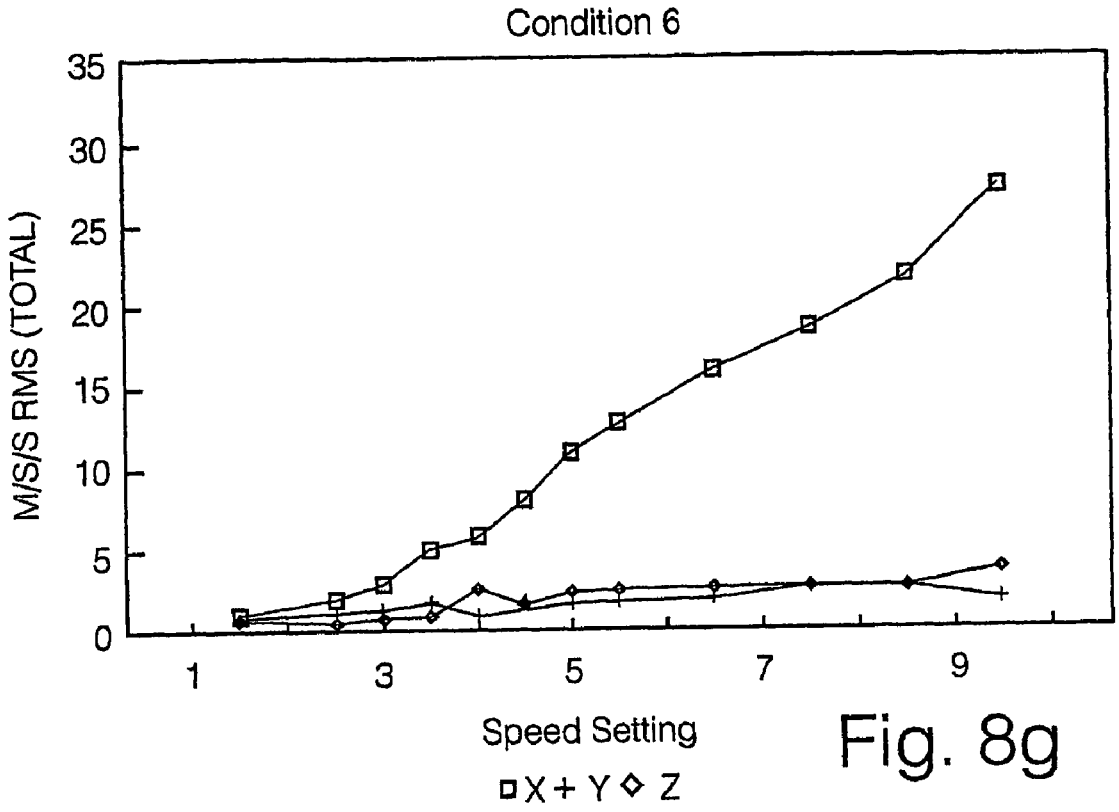
Figure 8H:
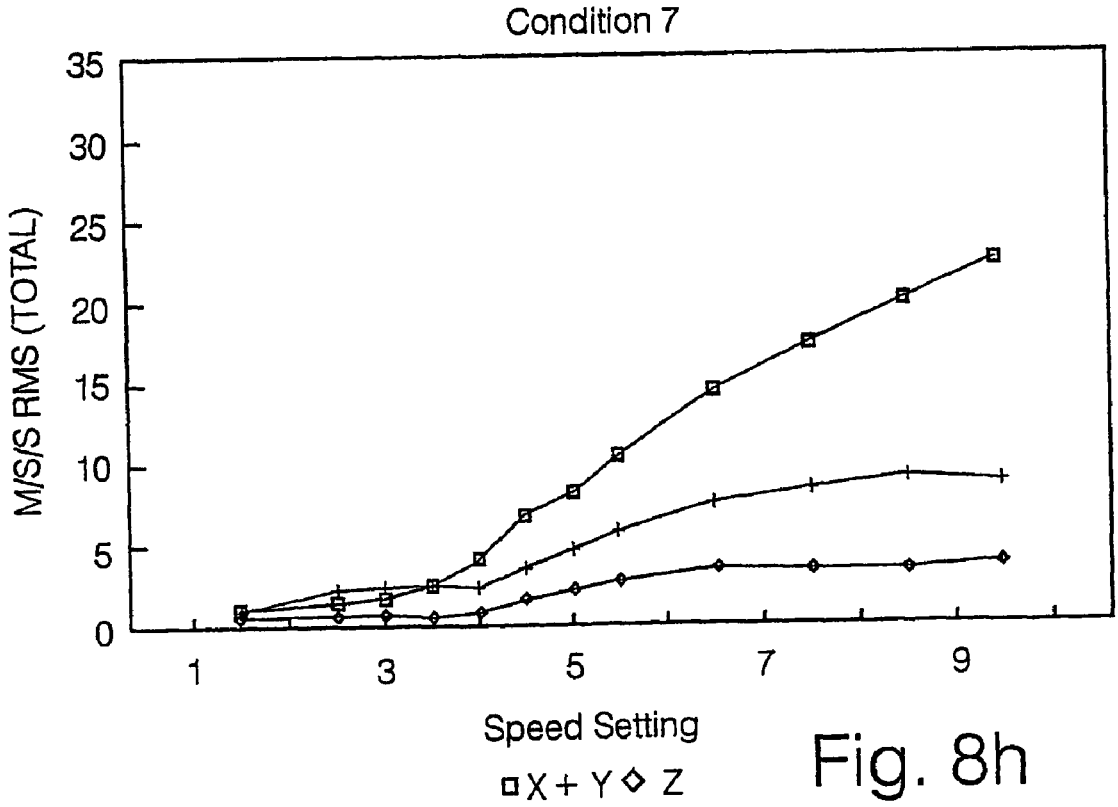
Figure 8I:
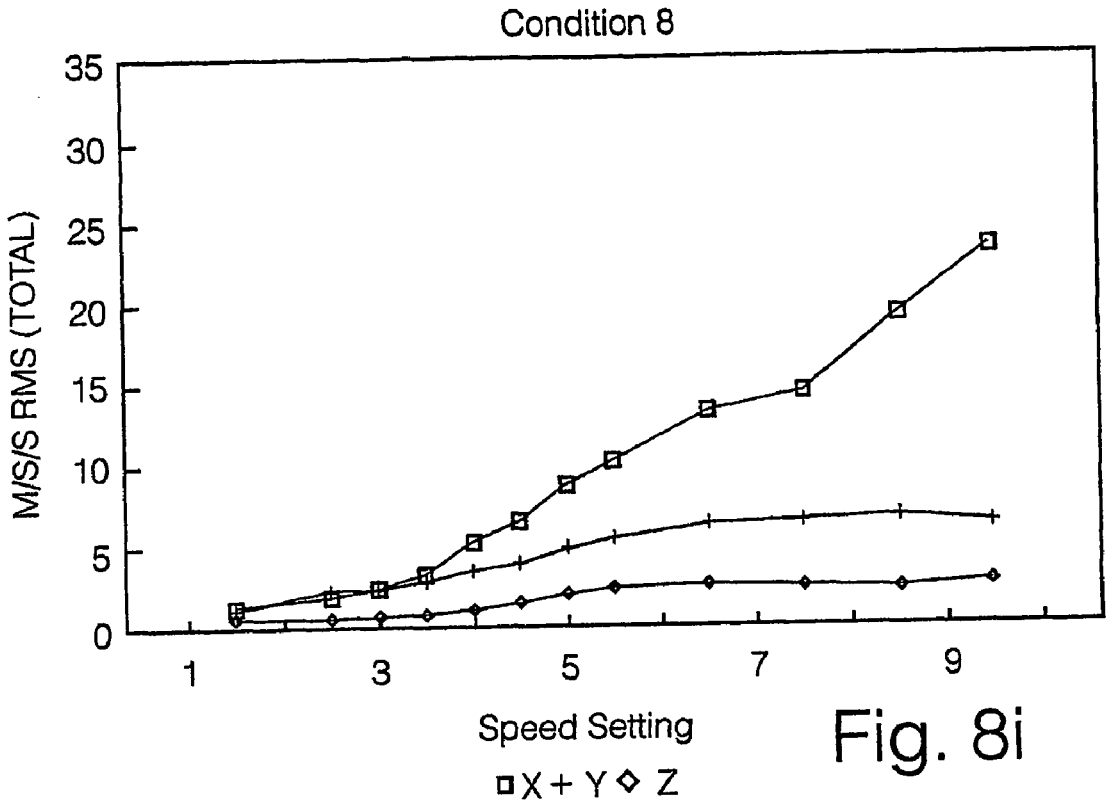
Figure 8J:
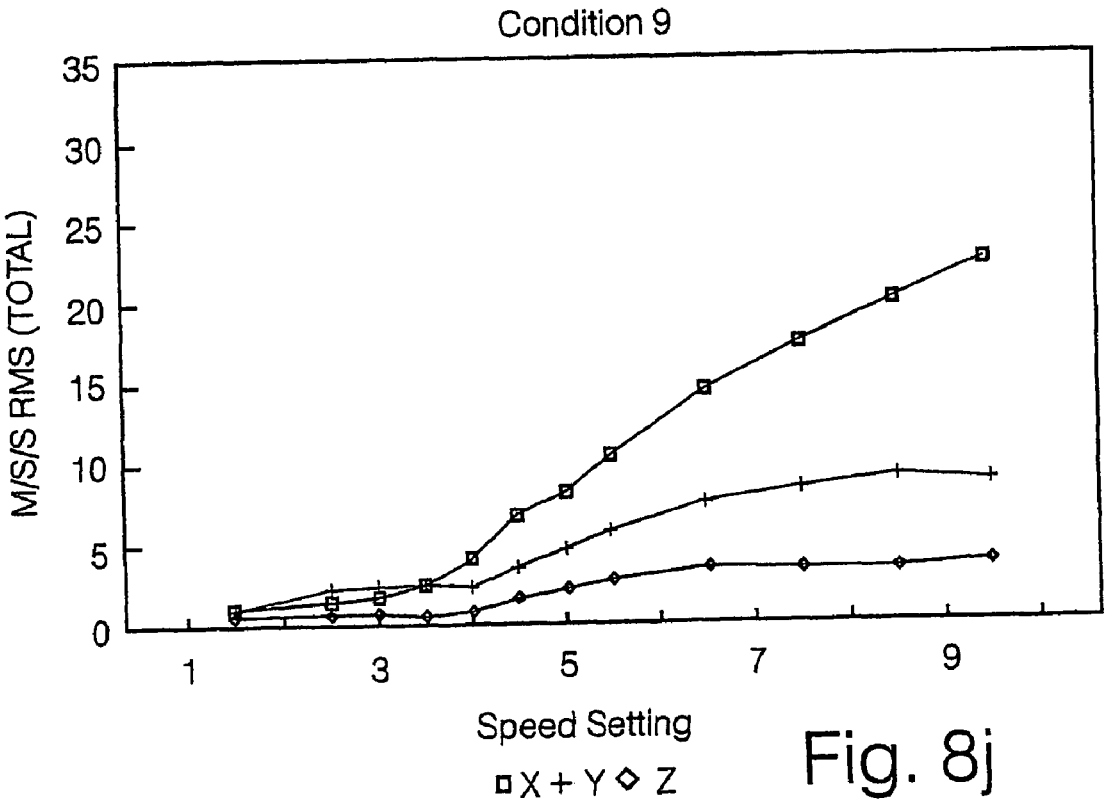

However, a speed control arrangement 90 is provided (see FIG. 7), conveniently disposed in a separate hand unit (not shown). Arrangement 90 controls the power supplied to the motor, and is connected to AC mains voltage 92, which typically is between 50-60 Hz. The mains supply is connected to a double bobbin isolation transformer T having a nominal 24 volt AC output. That supply is fed to a switch/rectifier 94, which in turn provides power to the motor 16 along cable 32.

However, a detector 96 detects the output of the transformer T and activates the switch 94 to commence supply of current to the motor 16 when the voltage is zero; that is to say, at each zero crossing of the supply voltage.

At the same time, the detector 96 activates a timer 98 to commence counting, the output of which counter is supplied to a comparator 100. The comparator 100 is also supplied with the value of a number stored in a memory 102 and, when the count of the counter 98 reaches the number stored in the memory 102, the comparator activates the switch 94 to interrupt supply of current to the motor 16.

The memory is provided with means 104 by which the number stored can be changed, so that the speed of the motor can be varied. Conveniently, it is found that the counter should count at a rate of about 25 KHz giving about 250 steps in each half cycle.

Because the frame 27 is rigidly fixed to the casing 14 of the drive unit 12, vibrations of the drive unit 12 are therefore transmitted to the pad 110. The pad is about 400 mm long and about 250 mm wide at the motor end and about 200 mm wide at its other end.

Figure 3:
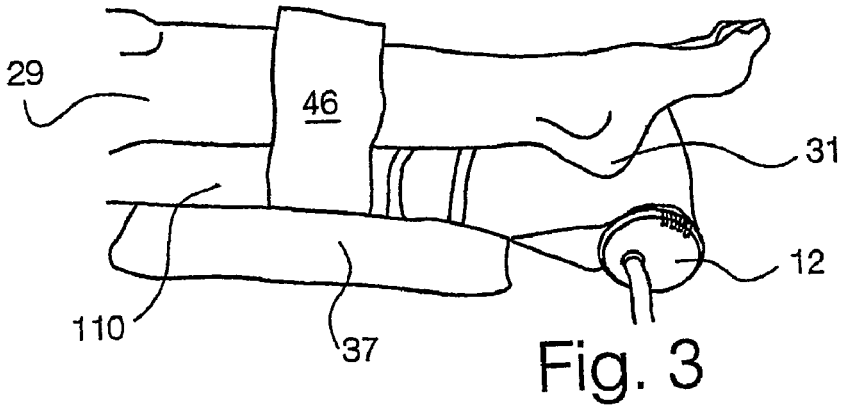
FIG. 3 is a side view of the device of FIG. 1 strapped to a patient's leg with the drive unit at the heel of the patient.
Figure 4:
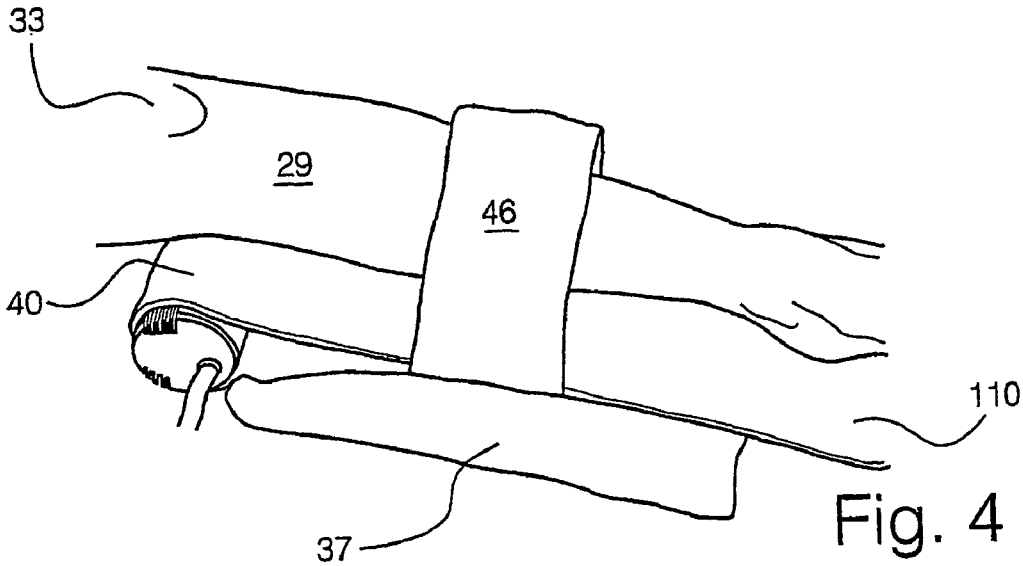
FIG. 4 is a similar view to FIG. 3, but with the drive unit under the knee of the patient.
Figure 2:
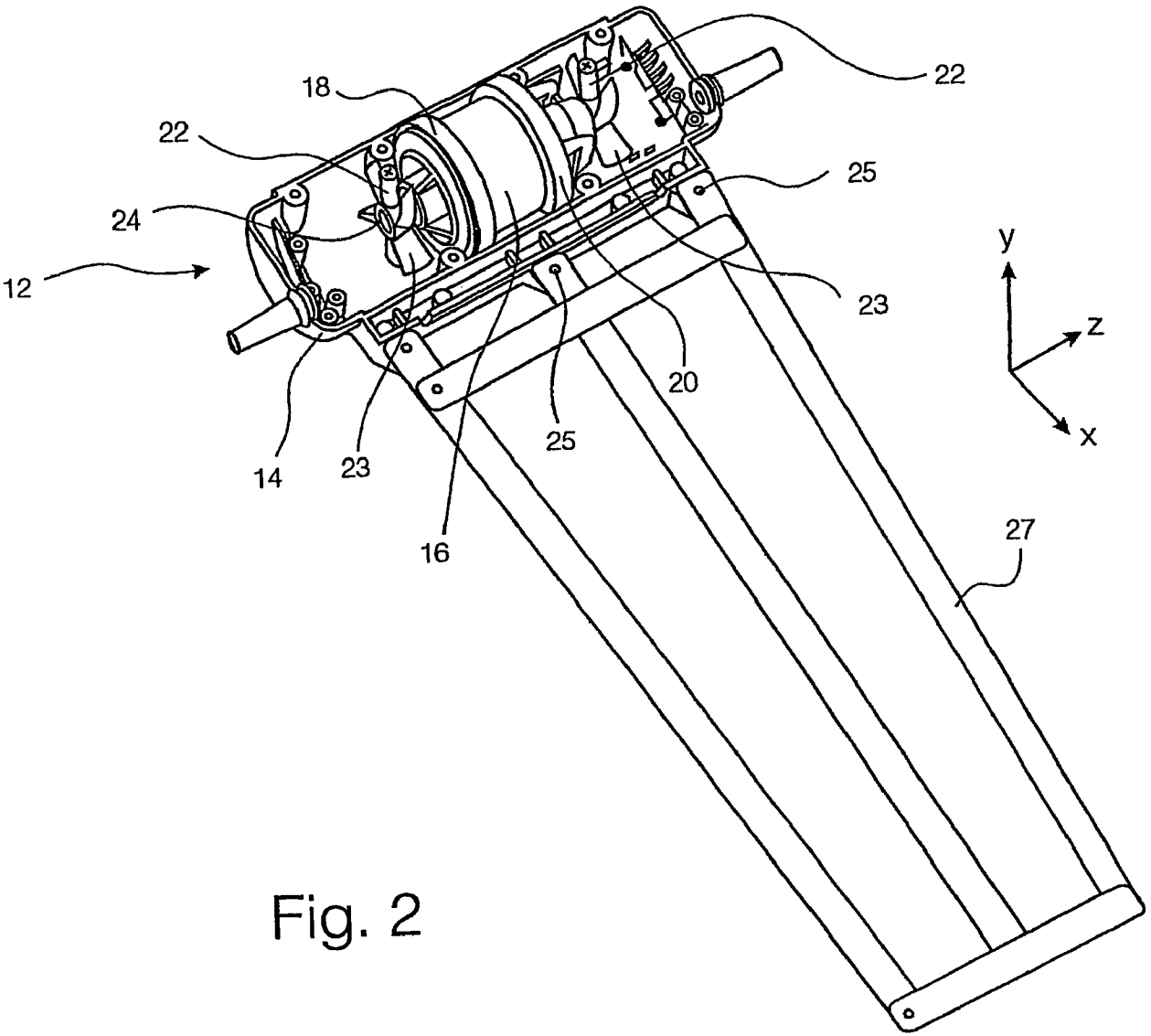
FIG. 2 is an assembly drawing of a drive unit and frame of the device of FIG. 1.
Figure 5:
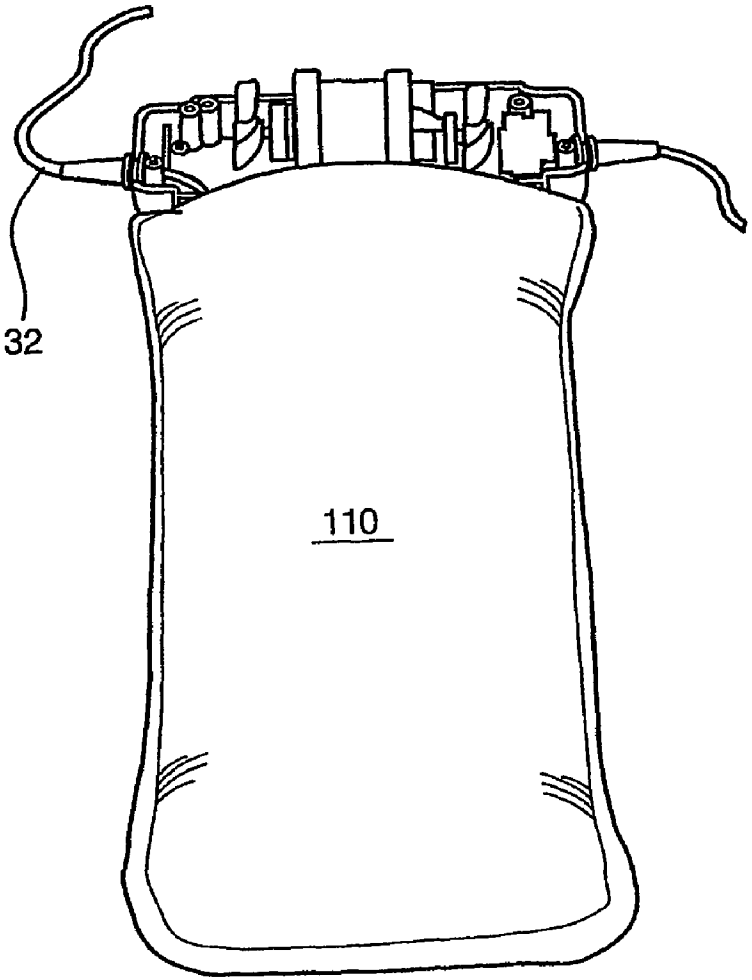
FIG. 5 is a perspective view of the device of FIG. 1, with the casing open.

In use, a patient suffering from a leg ulcer lays the affected leg 29 longitudinally along the pad. Whether the motor is at the heel end 31 of the leg, as shown in FIG. 3, or is under the knee 33, as shown in FIG. 4, is a matter of patient choice. However, if an ulcer is on the patient's ankle or lower leg, the former arrangement may be preferable, whereas if it is on the calf or higher, the latter arrangement may provide more direct delivery of vibrations to the site and environment of the ulcer.

Pressure applying means in the form of a strap 46 is employed to press the leg into close contact with the pad 110, although any means will do, such as a weight. The strap 46 conveniently is separate from the pad and comprises a band of material having hooped nylon on one surface and hooked nylon on the other. When its ends are overlapped and pressed together after wrapping around the patient's leg and pad, the strap secures the pad to the patient's leg. The strap is about 100 mm wide.

In any event, Table 1 shows the results of preliminary trials conducted on patients suffering long term problems with ulcers. In each case, the patient arranged a device 10 in accordance with the present invention as shown in FIG. 3 or 4 with a strap 46 comfortably, but firmly, pressing the pad 110 against the patient's leg.

The motor control was switched to setting 5 and vibration was effected for about thirty minutes 3 times per day. The results of these treatments are shown in Table I below.

In each case the conventional treatment regime was maintained, along side the vibration treatment. This comprised keeping ulcers dressed with multi-layer pressure bandages to reduce the potential for infection. Dressings were changed weekly.

TABLE I

| Patient Age and Sex | Age of Ulcer Weeks | Position of Ulcer | Vibration treatment (Weeks) | Reduced Swelling Y/N | Pain* Reduction Start/End | Improved Mobility Y/N | Condition of Ulcer after treatment |
|---|---|---|---|---|---|---|---|
| 84M | 100 | Ankle | 9 | Y** | 0/0 | | Reduced Size |
| 84F | 6 | Above ankle | 6 | Y | 2/0.5 (no pain at nights | | Scab in 3 weeks, healed in 6 weeks |
| 73M | 17 | Ankle | 10 | Y | 2/less | | 60% healed |
| 85F | 39 | Above ankle | 10 | N | 5/1 | | Reducing slowly |
| 86F | 17 | Above ankle | 5 | Y | 1/0 @ week 4 | | HEALED |
| 73M | 17 | Small ulcers | 5 | N | 1/0 @ week 2 | | HEALED |
| 54M | 75 | Ankle | 2 | Y (after 4 days) | 0/0 | | Improvement after 4 days |
| 73M | 200 | Ankle | 2 | Y | 2.5/1.5 | | Improving |
| 90M | 50 | Ankle | 2 | Minimal | 3.5/2.5 | | Healing |

*Pain is on scale 0 to 5 where 0 is no pain and 5 is intense pain
**Temporary increase in swelling at week 5 but reduced overall As can be seen from Table I above, the response of patients, even those afflicted with long term ulcers that had hitherto failed to respond to conventional methods of treatment, was in all cases favourable with healing to a greater or lesser extent being effected in each case.

A further study of ulcerated patients has been conducted. This study proposed to combine the two therapies of compression bandaging and cycloidal vibration to determine whether this would enhance the healing of venous leg ulceration. 18 patients with venous ulceration were offered a 12 week trial. The vibration device was used 3 times daily for 30 minutes at home, with twice weekly dressings using a non adherent dressing and a Setopress® compression bandage. 10 patients healed within 12 weeks and the remaining 8 patients completed the 12 week study with 31% to 90% reduction in ulcer size. Quality of life assessments showed a reduction of pain in 13 out of the 18 patients. 10 had some reduction of exudate. Ultrasound measurements showed reduced fluid content in the upper dermis in patients that had healed and in ulcers that were improving.

Methodology

Pre Study Visit

Prior to commencing the study, the patients were invited to a Leg Ulcer Clinic for a screening visit. This visit was designed to put the patient at ease and to promote rapport with their research nurse. Doppler ultrasound and Light Reflective Rheography were used to measure Ankle Brachial Pressure index and venous refilling time.

Light Reflective Rheography is a non-invasive tool to measure the venous refill in the lower leg. The patient sits on a chair with the heel on the floor. An infrared probe is attached by an adhesive disc 10 cm above the medial malleoli. The patient then performs 10 ankle dorsiflexions to empty the veins, keeping still whilst the veins refill. A graph is recorded giving the time in seconds for how long it takes to refill the vein. 25 seconds and above would show a normal refilling time, below would indicate venous disease.

Patients were given the opportunity to try a vibration device in accordance with the present invention. Patients were advised to use the device on their bed at home to promote venous drainage.

Ulcer history was recorded of duration and compression used, and a written consent obtained. A trial wearing the Setopress compression bandaging was undertaken to establish degree of comfort and wear time.

Following enrolment to the study, patients attended the Clinic twice weekly for dressing changes, or the research nurse visited the patient at home.

Dressing Change

At each dressing change the leg was washed in warm tap water, dried and moisturised with 50% White Soft Paraffin and 50% Liquid Paraffin (50/50) to hydrate the skin. A non-adherent dressing (NA®) was used as a primary dressing with a pad to absorb exudate. Tubifast®—a cotton tubular bandage—was applied to the lower leg to protect the skin. Softban®—a cotton wool bandage—was applied from the base of the toes to the tibial tuberosity to protect the malleolus and tibial crest, followed by the Setopress® compression bandage.

Outcome Measurements:

The following assessments were undertaken weekly.

Ulcer area using planimetry and photography.

Computer analysis of circumferential leg volume measurement at 4 cm intervals from malleolus to tibial tuberosity.

Quality of life assessment (pain/exudate/odour)

Pain assessment was established by a visual analog scale from 1-5. (None, mild, uncomfortable, horrible or excruciating).

Exudate was established by the amount of strike through of the NA, pad or bandage on a scale of none, mild moderate or heavy.

Odour was qualitatively assessed nasally by the patient and the research nurse on the scale of none, mild, moderate or offensive.

Dermascan® Ultrasound scans were taken at 4 weekly intervals to establish tissue hydration and dermal structure of both lower legs. The non-study leg was used as a control. Predetermined areas at three points of each leg—lower (ankle), middle (calf) and upper (below knee) were documented at the first scan to ensure that the same area was successively scanned.

Results:

18 patients either completed the 12 weeks or healed with a healing rate of 55.5%. 10 patients healed with a mean healing time of 7.2 weeks (range: 4-12 weeks). Their average ulcer size at the start of the trial was 3.71 $cm^2$ (range 1.5 $cm^2$-7.0 $cm^2$), and they had a mean duration 9.35 months (range 1.5-24 months). Of the 8 patients that completed the 12 week study, 3 patients had ulcers greater than 10 $cm^2$, with a reduction of ulcer size of 63-65%. Average ulcer size for them at the start of study was 18.25 $cm^2$ (range 13.5 $cm^2$-28.75 $cm^2$), with a mean duration of 29 months (range 4-48 months). Finally, the 5 patients with ulcer size less than 10 $cm^2$ (range 2-9 $cm^2$) had a mean reduction in size of 50% at the end of the trial. Their initial mean size was 6.55 $cm^2$ (range 2-9 $cm^2$) and duration of 8 months (range 2-24 months). More detail can be seen in Tables II, III and IVa and b below.

Quality of life assessments showed a reduction of pain in 13 patients and reduction of exudate in 10. 12 patients experienced no ulcer odour during the treatment, 1 patient ulcer odour resolved at 3 weeks. The remaining 5 patients had ulcer odour that fluctuated between none, mild or moderate.

Computer analysis of the patients circumferential volume measurements of the lower leg showed a 1%-15% reduction in fluid volume.

TABLE II

Patient Demographics
Gender: 5 males/13 females

| | Range | Mean |
|---|---|---|
| Patient Age: | 51-93 years | 74 years |
| Ulcer duration: | 1.5-48 months | 12.3 months |
| Initial ulcer size: | 0.75 $cm^2$-28.75 $cm^2$ | 8.5 $cm^2$ |

TABLE III

Data results

| | Range | Mean |
|---|---|---|
| Healed (10 = 55.5%) | | |
| Ulcer duration: | 1.5-24 months | 9.35 months |
| Initial ulcer size: | 0.75 $cm^2$-7 $cm^2$ | 4 $cm^2$ |
| Healing time: | 4-12 weeks | 7.2 weeks |
| % of volume reduction | 1-8% | 4% |
| Improved but not healed - 3 patients> | | |
| 10 $cm^2$ | 4-48 months | 29 months |
| Ulcer duration: | 13.5-28.75 $cm^2$ | 18.25 $cm^2$ |
| Initial ulcer size: | 63-65% | 64% |
| % ulcer size reduction: | 2-15% | 8.00% |
| % of volume reduction: | | |
| Improved but not healed - 5 patients< | | |
| Ulcer duration: | 2-24 months | 6 months |
| Initial ulcer size: | 19 | |
| % ulcer size reduction: | 31-90% | 50% |
| % of volume reduction: | 4-10% | 8% |

TABLE IVa

Ulcers < 10 $cm^2$ at Start

| Pat. No. | Age (months) | Duration ($cm^2$) | Start Size ($cm^2$) | End Size ($cm^2$) | Weeks | % Reduction |
|---|---|---|---|---|---|---|
| 1 | 86 | 24 | 9 | 6.25 | 12 | 31 |
| 2 | 84 | 1.5 | 7 | | 6 | 100 |
| 4 | 85 | 3 | 8.5 | 5.25 | 12 | 38 |
| 5 | 9 | 5 | 8 | | 5 | 100 |
| 6 | 73 | 4 | 2.25 | | 5 | 100 |
| 18 | 78 | 10 | 4.25 | | 9 | 100 |

TABLE IVa-continued

| Pat. No. | Age (months) | Duration ($cm^2$) | Start Size ($cm^2$) | End Size ($cm^2$) | Weeks | % Reduction |
|---|---|---|---|---|---|---|
| | | Ulcers < 10 $cm^2$ at Start | | | | |
| 19 | 55 | 3 | 1.5 | | 4 | 100 |
| 22 | 74 | 8 | 8 | 2.75 | 12 | 48 |
| 25 | 74 | 8 | 8 | 4.5 | 12 | 44 |
| 26 | 75 | 3 | 6.75 | | 4 | 100 |
| 28 | 74 | 48 | 3 | | 9 | 100 |
| 30 | 56 | 4 | 2 | | 12 | 100 |
| 32 | 72 | 10 | 0.75 | | 12 | 100 |
| 33 | 59 | 2 | 2 | 0.1 | 12 | 90 |
| 34 | 51 | 6 | 2.6 | | 8 | 100 |
| | Totals: | 133.5 | 69.85 | | | |
| | Mean: | 8.9 | 4.66 | | | 83.40% |

TABLE IVb

| Pat. No. | Age (months) | Duration (months) | Start Size ($cm^2$) | End Size ($cm^2$) | Weeks | % Reduction |
|---|---|---|---|---|---|---|
| | | Ulcers > 10($cm^2$) at Start | | | | |
| 3 | 74 | 4 | 13.5 | 4.8 | 12 | 64 |
| 13 | 93 | 36 | 12.25 | 4.5 | 12 | 63 |
| 31 | 83 | 48 | 28.75 | 10 | 12 | 65 |
| | Totals: | 88 | 54.75 | | | |
| | Mean: | 29 | 18.25 | | | 64 |

Turning now to FIGS. 8 to 11, these illustrate graphically the vibration regime established by the pad under the conditions shown in Table V below.

TABLE V

| Condition | Subject | Motor at | Support | Strap | Measured at |
|---|---|---|---|---|---|
| 1 | A | Knee | Free | Tight | Middle |
| 2 | A | Knee | Firm | Tight | Middle |
| 2A | A | Knee | Soft | Tight | Middle |
| 3 | A | Knee | Soft | Tight | Motor end |
| 4 | A | Knee | Soft | Loose | Middle |
| 5 | A | Heel | Soft | Tight | Middle |
| 6 | A | Heel | Soft | Tight | Other end |
| 7 | A | Heel | Firm | Tight | Middle |
| 8 | B | Heel | Firm | Tight | Middle |
| 9 | B | Heel | Soft | Tight | Middle |

The same subject person (A) was used in most tests. The position of the motor was varied between under the "Knee" (FIG. 4 arrangement) or at the "Heel" (FIG. 3 arrangement). The leg with the pad attached was either "Free" (not shown), supported on a "Firm" base, or supported on a "Soft" cushion 37. The strap 46 was either "Tight" or, in one case, "Loose". Measurements of accelerations were made using accelerometer transducers positioned to measure in each of the three axes x, y and z. The transducers (not shown) were disposed on a base 35 (see FIG. 1) between the pad 110 and the subject's leg 29. The base was either in the "Middle" of the pad, at the "Motor end" thereof, or it's "Other end". The use of quotation marks is merely a reference to the same terms used in Table II above.

Figure 11A:
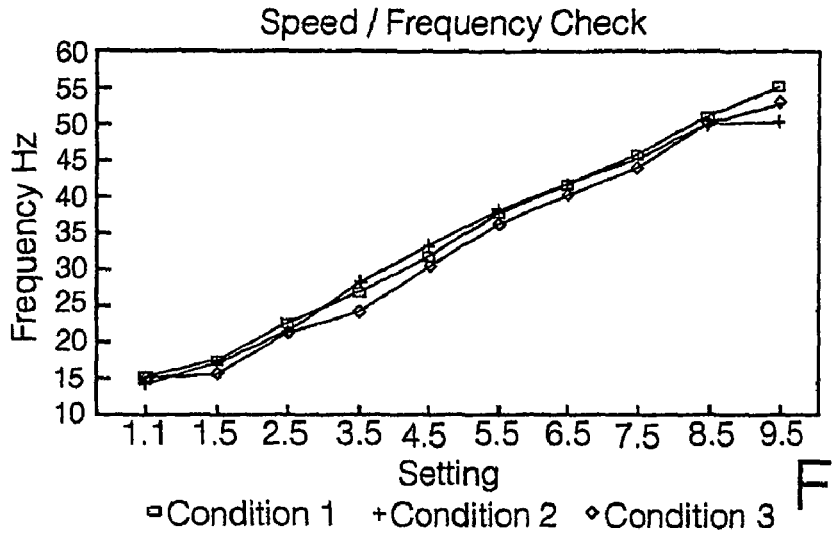
FIGS. 11*a, b* and *c* show the frequency of operation for different conditions of operation against speed setting of the device.
Figure 11B:
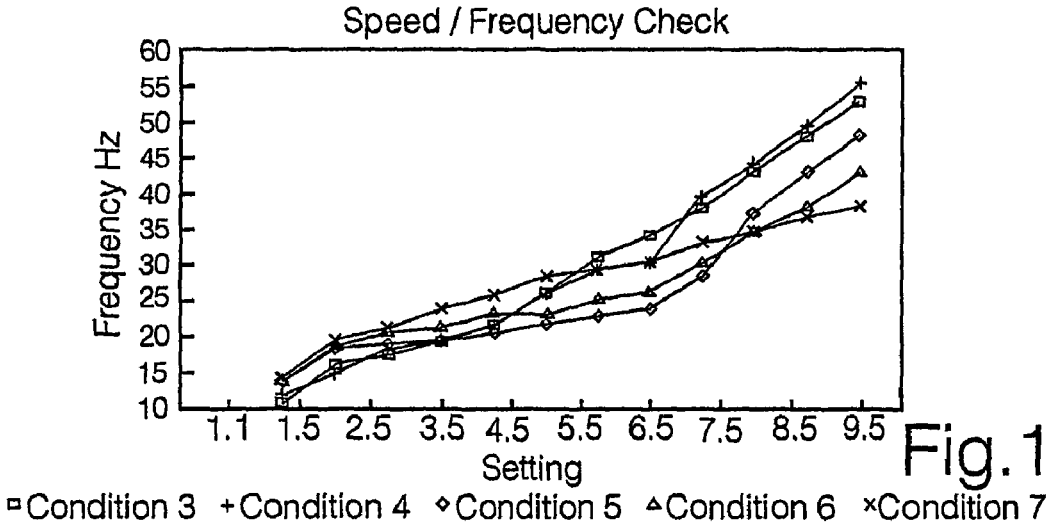
Figure 11C:
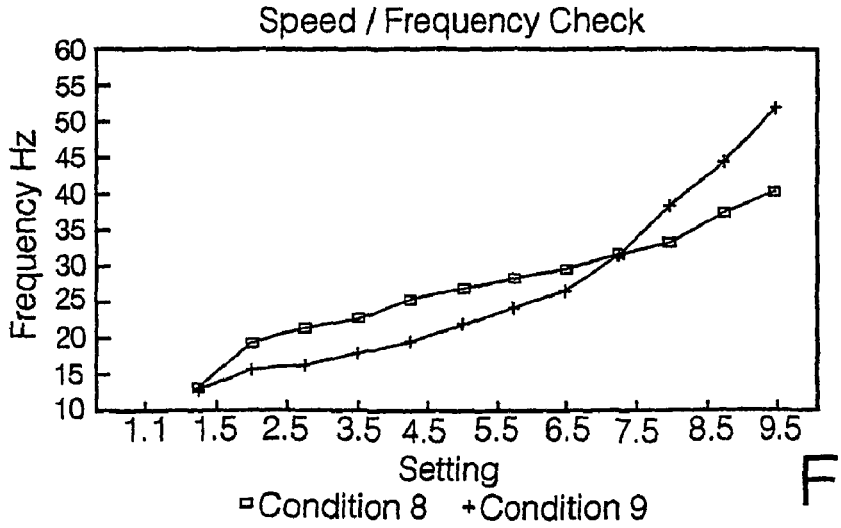

Referring first to FIGS. 11*a, b* and *c*, in most conditions, the frequency of operation was consistently proportional to speed setting. However, when a particularly rigid connection is achieved (see conditions 7 and 8 where the motor was under the heel of the subject, there was firm support, and a tight strap), the subject's leg will have absorbed substantial energy from the device. This results in a reduction in the increase of speed and frequency with increasing speed setting.

Referring to FIGS. 8*a* to *j*, it can be seen that, with increasing speed, the acceleration in the x direction, which is in the longitudinal direction with respect to the subject's leg, increases exponentially. On the other hand, in the y and z directions, the increase is more proportional and in some cases not especially apparent. It is suspected that it is partly for this reason that it is found in practice that a speed setting between 4 and 5 appears to be the optimal treatment speed. Indeed, in some conditions, the z component of acceleration almost disappears at higher speeds, leaving essentially just one dimension (x) to the vibration, with a minor component in the y direction.

However, at speed setting 5 or thereabouts, the vibration is quite evenly three dimensional. This is particularly the case with the strap in place. Conditions 2A and 4 are identical except that condition 4 has the strap loose. It can be seen that at a speed setting between 4 and 5 the components in the y and z directions are much nearer the value in the x direction when the strap is tight than when it is loose.

Figure 9A:
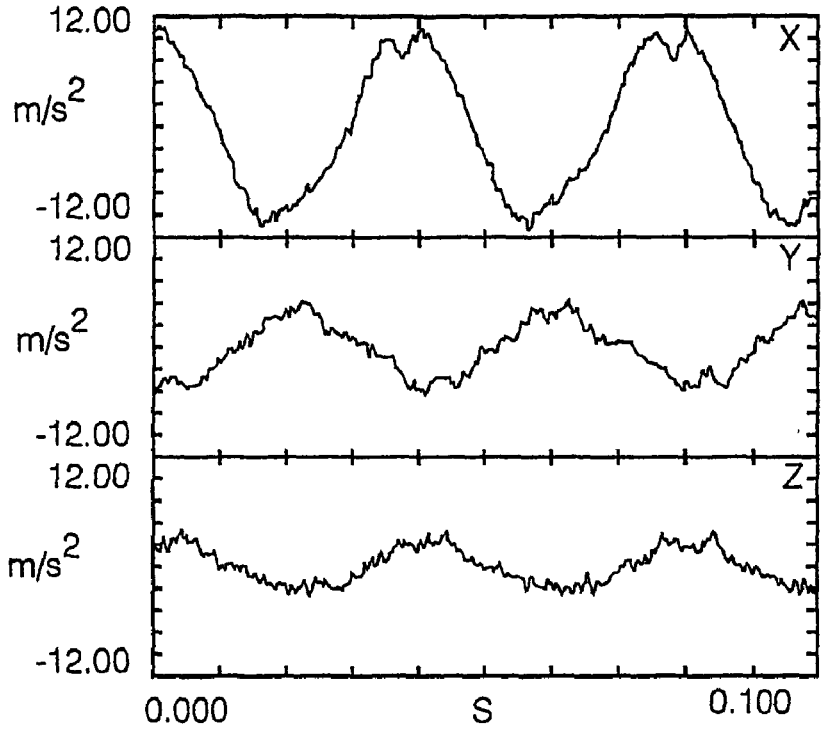
FIGS. 9*a* and *b* are respectively graphs of acceleration in each direction plotted against time, and a frequency range plot in each direction, both at a preferred speed of operation.

In FIG. 9*a*, the actual acceleration in each direction is plotted against time so that, for example, over about 0.1 seconds 2.5 acceleration cycles occur. This equates to a frequency of about 25 Hz, the amplitude of the accelerations being greatest in the x direction and least in the z direction. In FIG. 9, the speed setting is 4.5, whereas in FIG. 10 it is 9.5, so that about six acceleration cycles of substantially greater amplitute occur in the measurement period. This equates with a frequency of about 60 Hz.

Figure 9B:
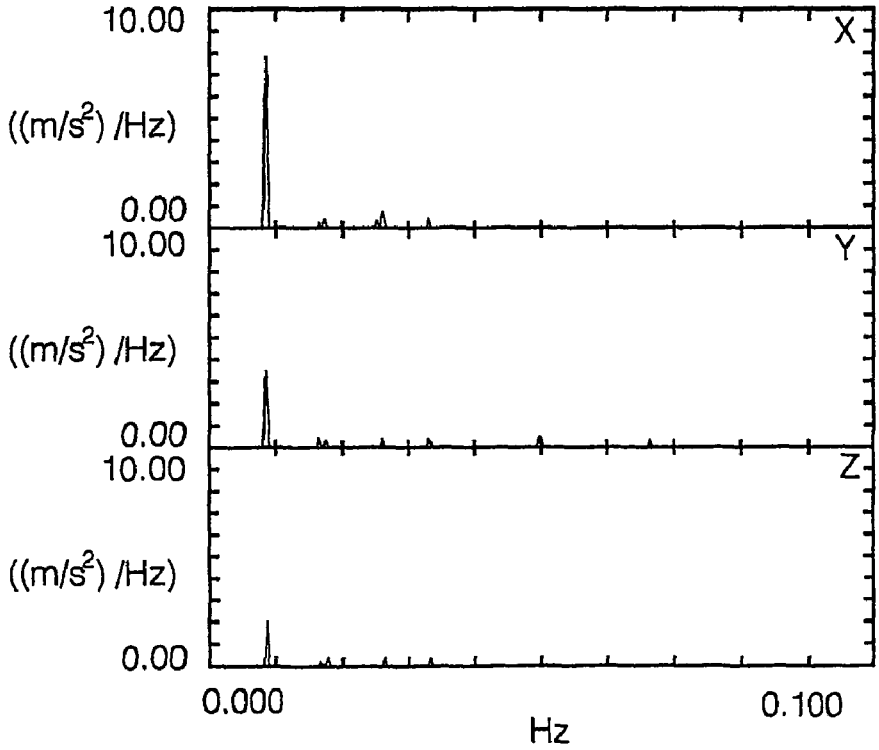
Figure 10A:
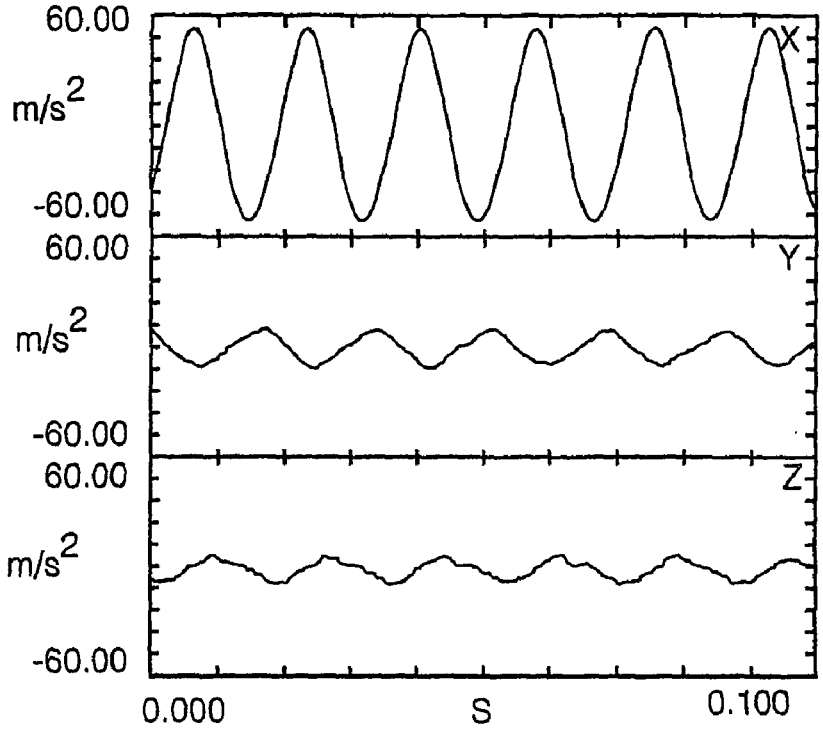
FIGS. 10*a* and *b* are as FIG. 9, but at a higher speed.
Figure 10B:
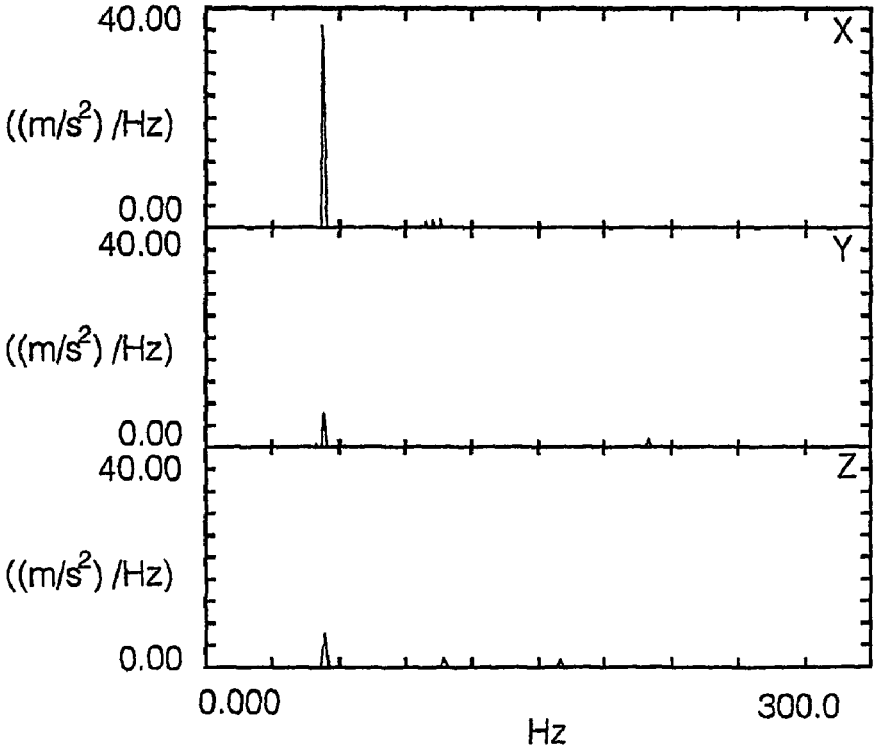

In both FIGS. 9*b* and 10*b*, the frequency range is plotted against the acceleration at each frequency and it can be seen that there is only one spike of any significance in each direction at both speed levels.

Figure 12A:
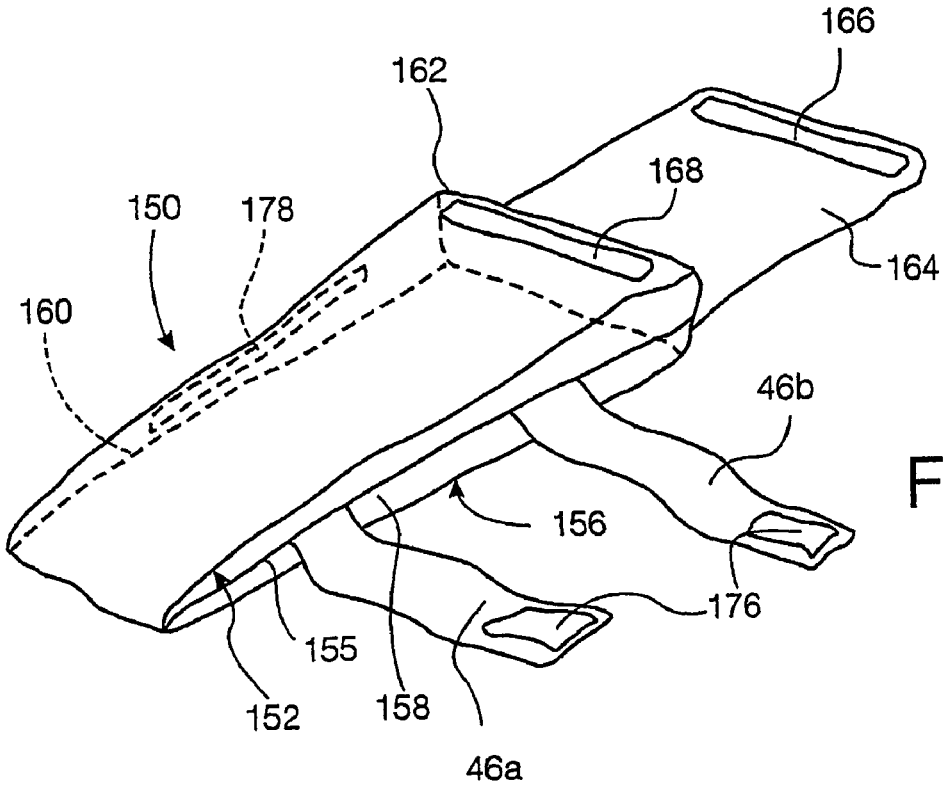
FIGS. 12*a, b* and *c* show a cover in accordance with the present invention: in perspective view; in perspective view again but with a device inside; and in plan as a blank before assembly.

Turning to FIGS. 12*a, b* and *c*, a cover 150 is illustrated comprising a pouch 152 of an impervious material such as plastics or nylon. In the context of the present invention, "impervious" should be understood to mean that liquid weeping from a bandaged ulcer of a patient undergoing treatment with the device will not, on the whole, penetrate the material and contaminate the pad. However, for the purposes of patient comfort, the cover may not be utterly impervious and therefore on occasions some contamination could occur if significant leakage occurs.

The pouch has a front 154 and a back 156, and two sides 158, 160. The pouch 152 has a top lip 162 and, on the rear side 156 of the pouch a flap 164 depends from the lip 162.

At the end of the flap is a strip 166 of hooped nylon material. On the front face 154 of the pouch, near the lip 162, is a strip of hooked nylon 168.

The pouch 152 is shaped to snugly receive the pad 110 of a massage device 10 of the type shown in FIGS. 1 to 6. The motor 12 is not received in the pouch 152. Instead, the flap 164 covers the motor when the flap is folded over and the first and second fasteners formed by the strips 166, 168 are interengaged. Thereupon, the flap defines, with the lip 162 at the sides 158, 160, two openings 170, 172 through which the ends of the drive unit 12 project. The drive unit 12 has cooling slots 174 through which air is drawn to cool the motor 16 by the fans 23. This flow is therefore not impeded by the cover 150.

Figure 12B:
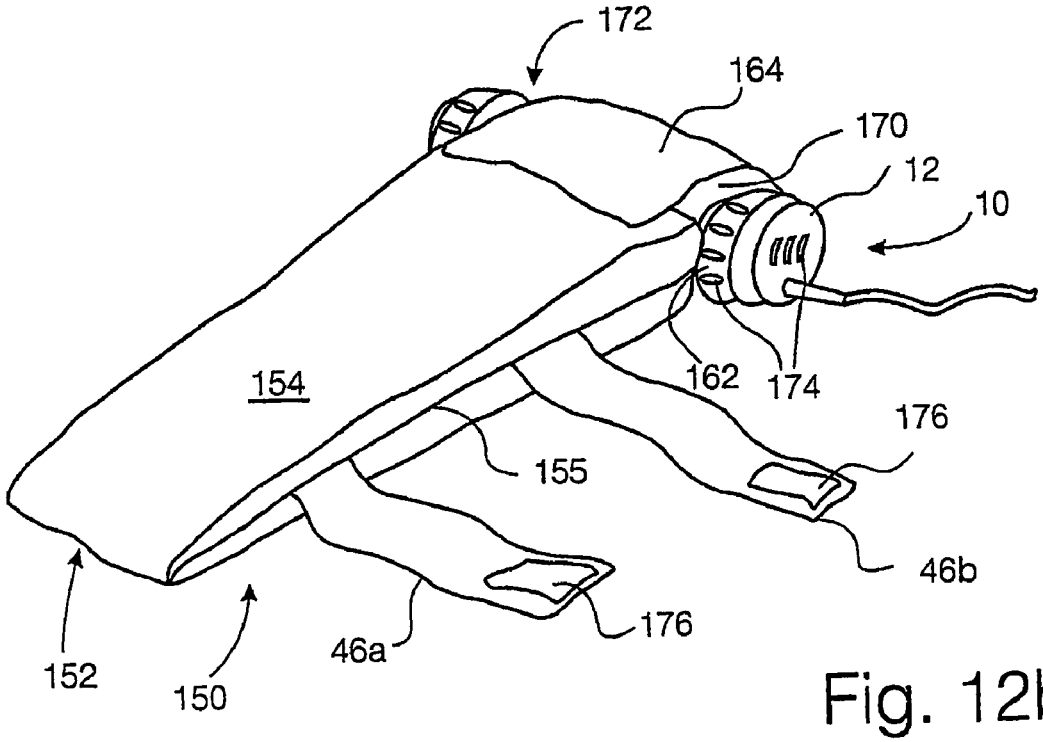
Figure 12C:
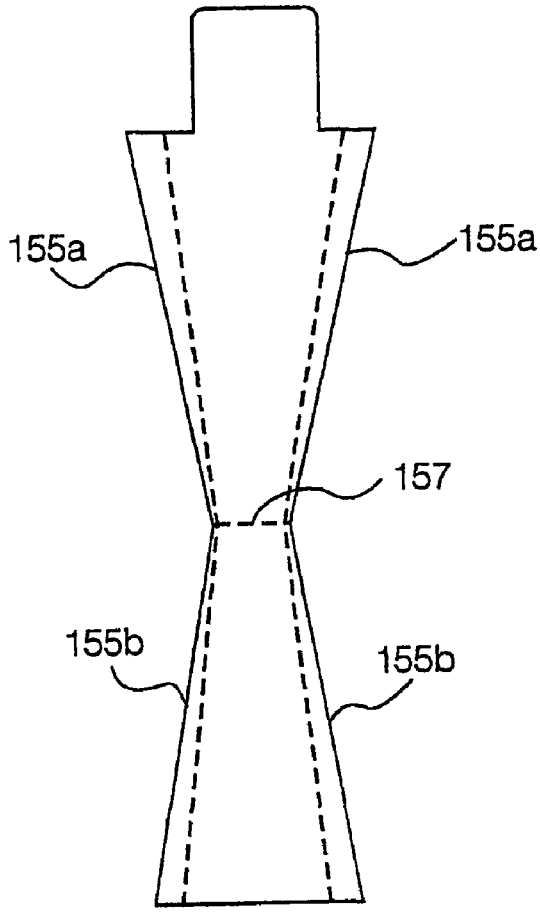

The cover 150 has two straps 46*a, b* sewn into the join 155 between the front rear faces 154, 156 (indeed, the pouch is conveniently formed by sewing a blank as shown in FIG. 12*c* along edges 155*a, b* after folding along line 157 forming the bottom end of the pouch). The straps 46*a, b* have strips 176 of hooped nylon at their ends. On the other side 160 of the pouch is provided a long strip 178 of hooked nylon. The strips 176, 178 form third and fourth fasteners and when a patient's leg is placed along the pad 110 (front face 154 of cover 150) the leg can be pressed against the device 10 by folding over the straps 46*a, b* and engaging the fasteners 176, 178.

Should either strap tend to apply pressure to an ulcer on the patient's leg, the elongate strip 178 permits longitudinal adjustment of the attachment of the straps. Indeed, one strap could be omitted altogether without detracting from the benefits of the invention.

The strips 176 are somewhat elongate in order to accommodate different dimensions of different patient's legs.

Figure 13:
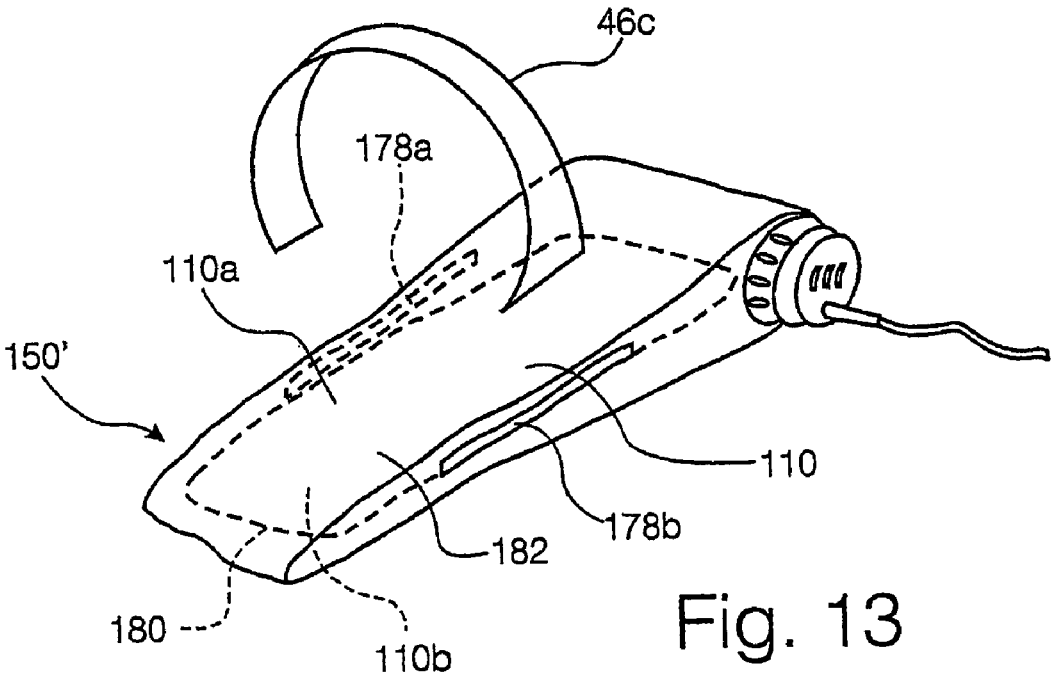
FIG. 13 shows in perspective another form of cover within the ambit of the present invention.

FIG. 13 illustrates an alternative embodiment of a cover within the ambit of the present invention. Any cover that serves the purpose of protecting the pad from contamination has its place, but FIGS. 12 and 13 illustrate novel covers. Cover 150' comprises a simple sheet 182 of material that is impervious to liquid weeping form ulcers. The sheet has a hem 180 incorporating a tie string (not shown) which can gather the edges of the sheet on the underside 110*b* of the pad 110. The cover is drawn taught over the top, that is to say, operative, side 110*a* of the pad 110. Alternative tightening arrangements are quite feasible, for example, several draw strings could be provided at the corners and sides of the sheet 150 to be tied together across underside 110*b* of the pad 110.

In any event, a strap 46*c* could be integrated with the cover 150', as described above with reference to FIG. 12, or be separate, as shown in FIG. 13. In this case, two strips 178*a, b* of hooked material are provided along the sides of the sheet 150, while the strap 46*c* either comprises, or is covered with, hooped material. Then, when the cover is on the pad, and a patient's limb is resting on the top side 110*a* of the pad 100, the strap 46*c* can be applied anywhere along the length of strip 178*a* (for example) of the cover 150', passed over the patient's limb and fastened to the strip 178*b*. The possibility of variation of the positioning of the strap with respect to the patient's limb is an important comfort feature.

The effect of the strap can be seen most clearly with reference to FIGS. 14*a* to *h*. These illustrate the results of pressure measurements employing a pressure mat disposed between the leg of a subject and the pad of a vibratory massage device in accordance with the present invention. The mat measures pressure in mmHg over its area, and so as to provide a contour map of pressure.

Figure 14A:
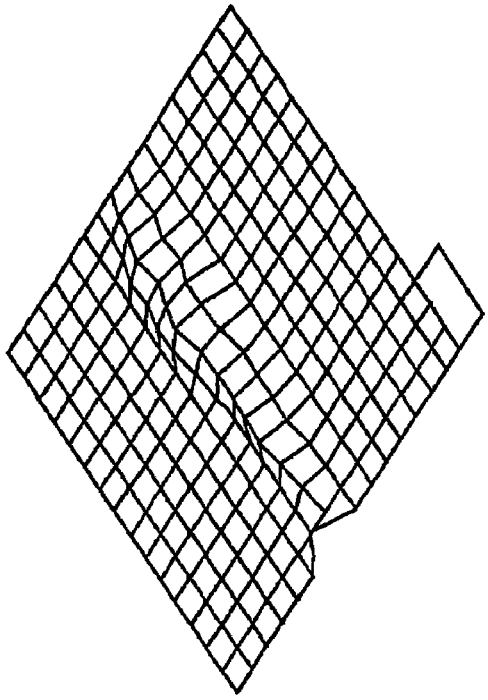
FIG. 14*a* to *h* illustrate a contour map of pressure between the leg of a subject and a vibratory massage device according to the present invention, each in different circumstances.
Figure 14A:
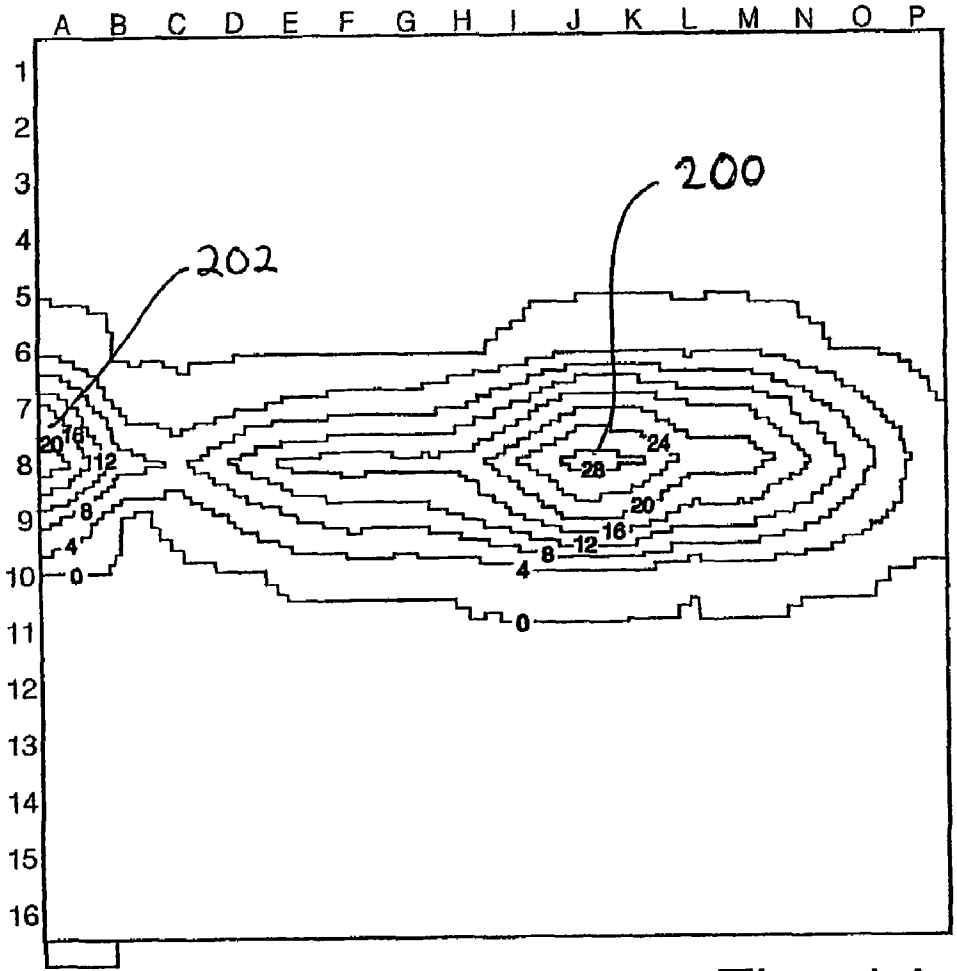
Figure 14B:
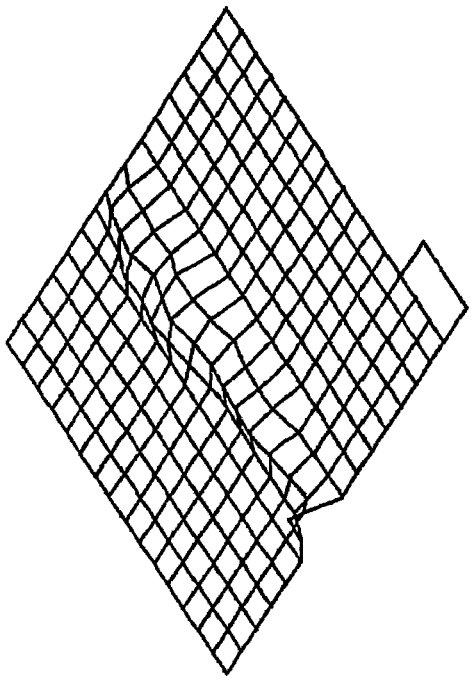
Figure 14B:
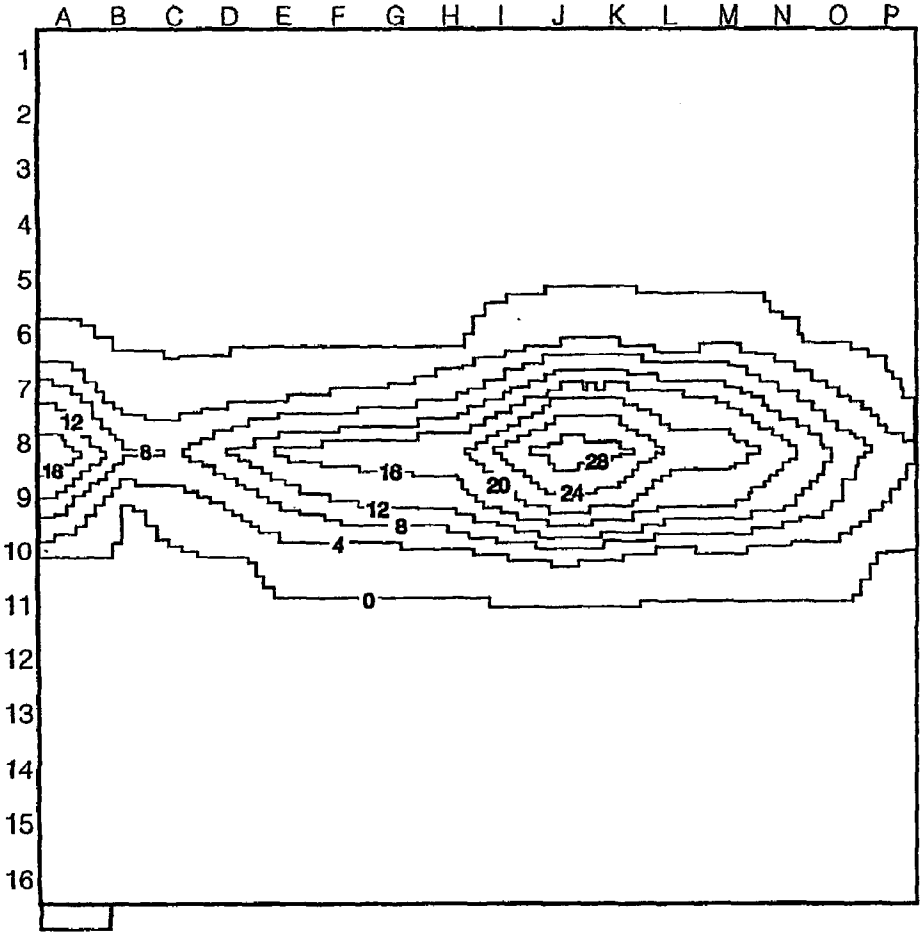
Figure 14C:
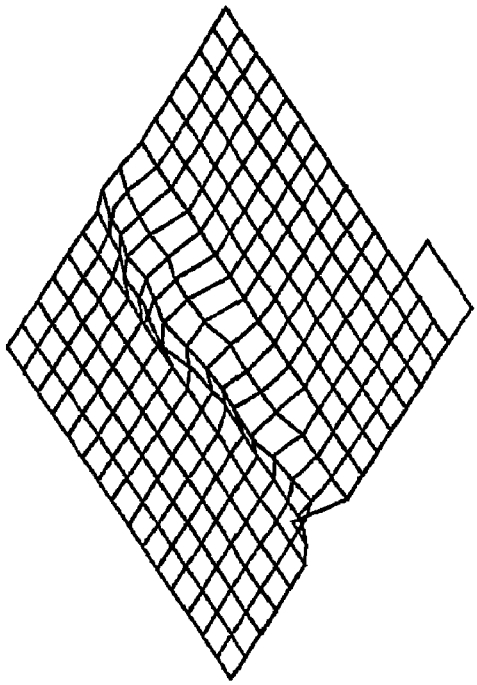
Figure 14C:
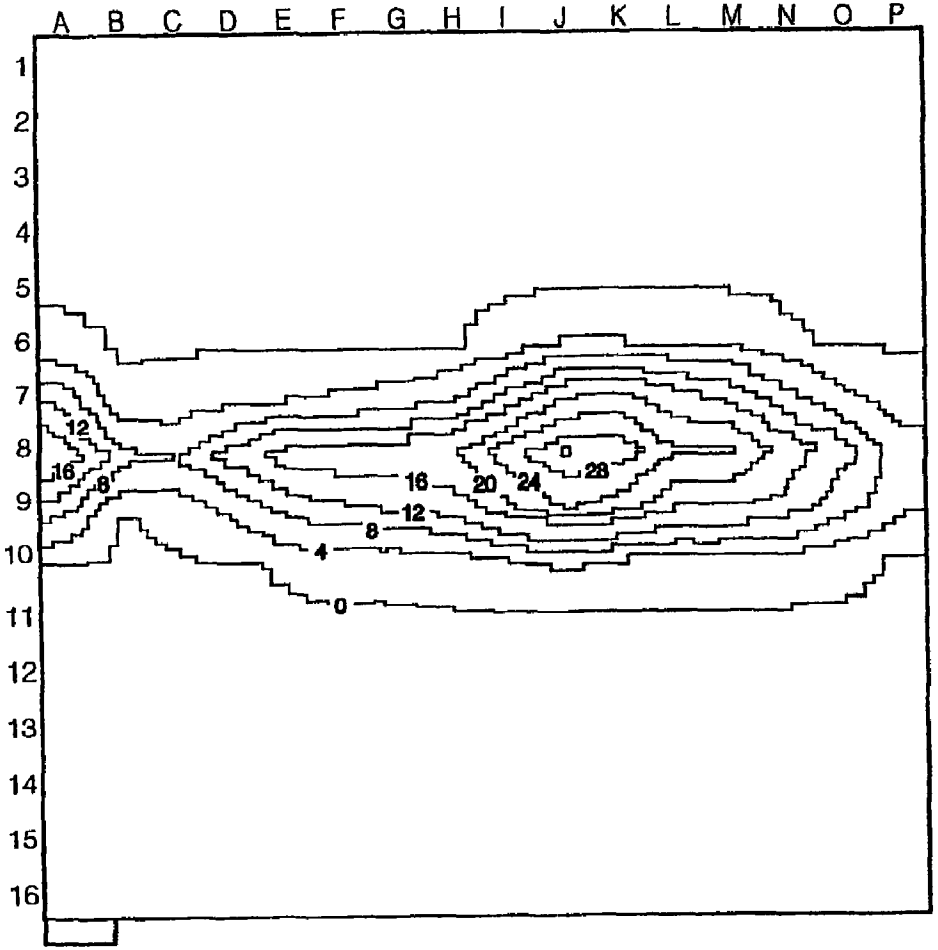
Figure 14D:
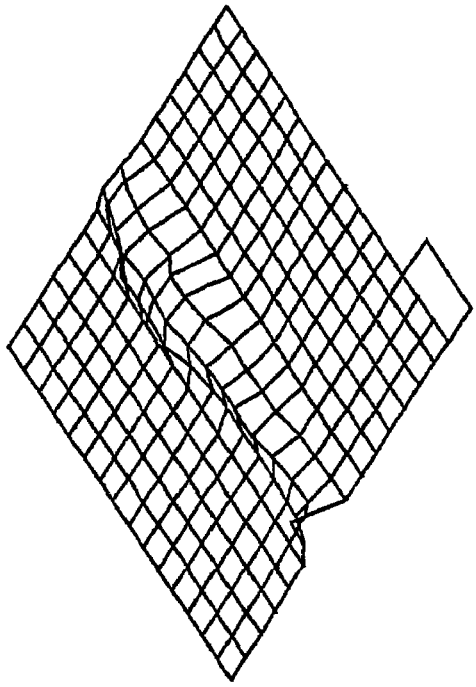
Figure 14D:
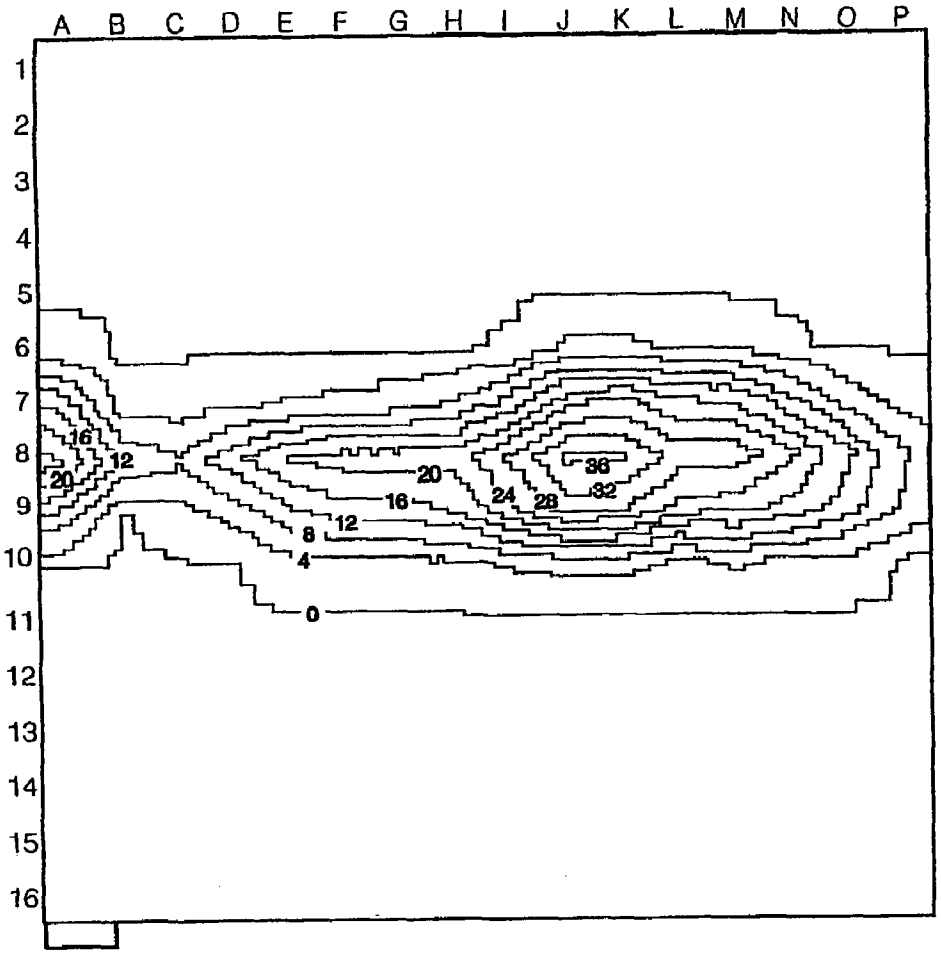

In FIGS. 14*a* to *e*, the subject's leg rests unstrapped (ie loosely) on the pad. The arrangement is with the motor under the knee of the subject with the calf of the subject receiving most of the pressure of the pad (at 200, FIG. 14*a*) and the heel also (at 202). In FIG. 14*a*, no vibratory massage is applied, but through FIGS. 14*b, c* and *d*, vibration is set at levels 3, 4 and 5 respectively of the device.

Figure 14E:
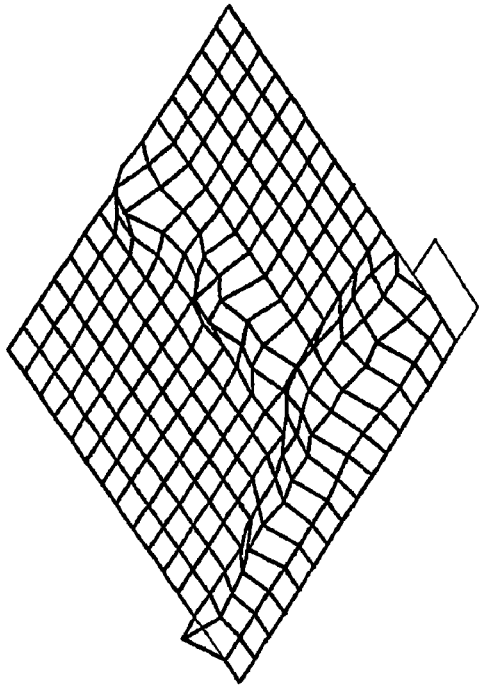
Figure 14E:
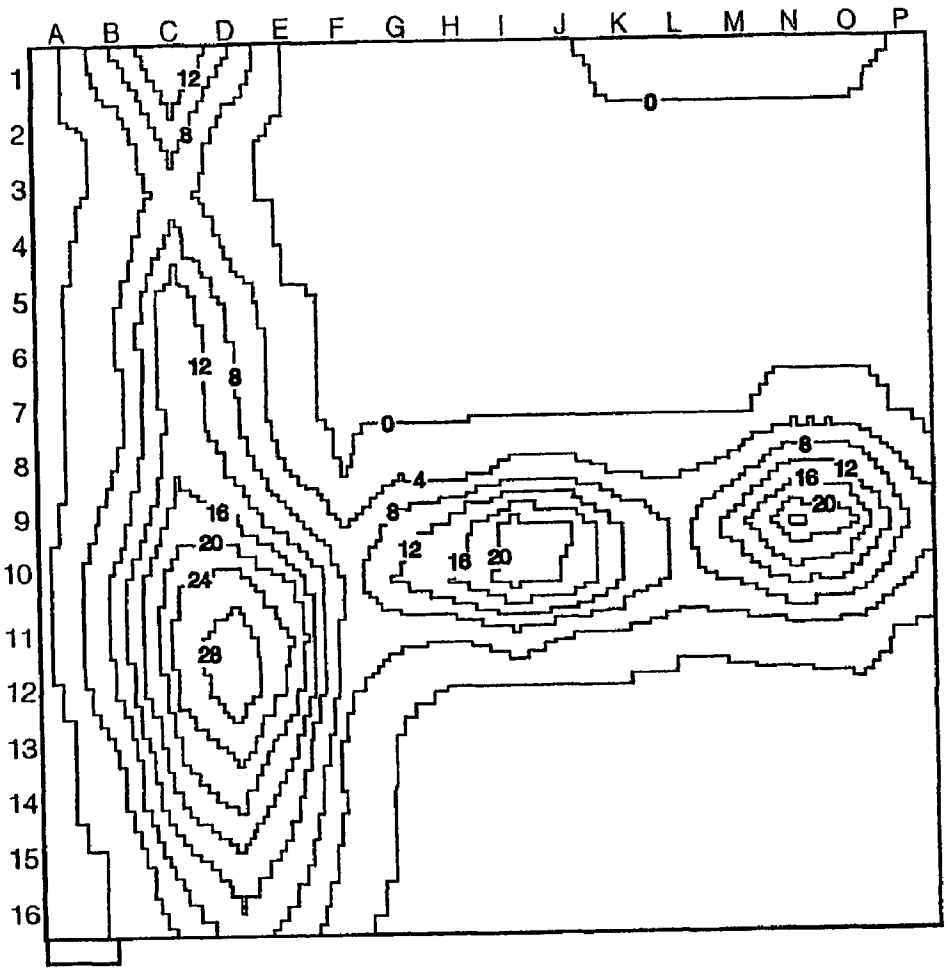
Figure 14F:
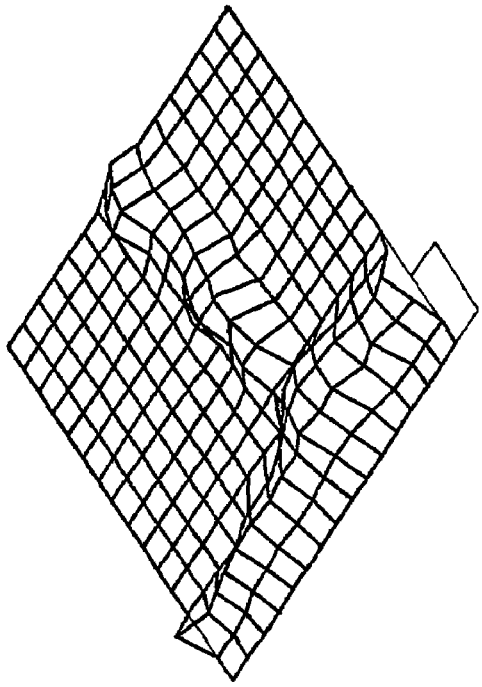
Figure 14F:
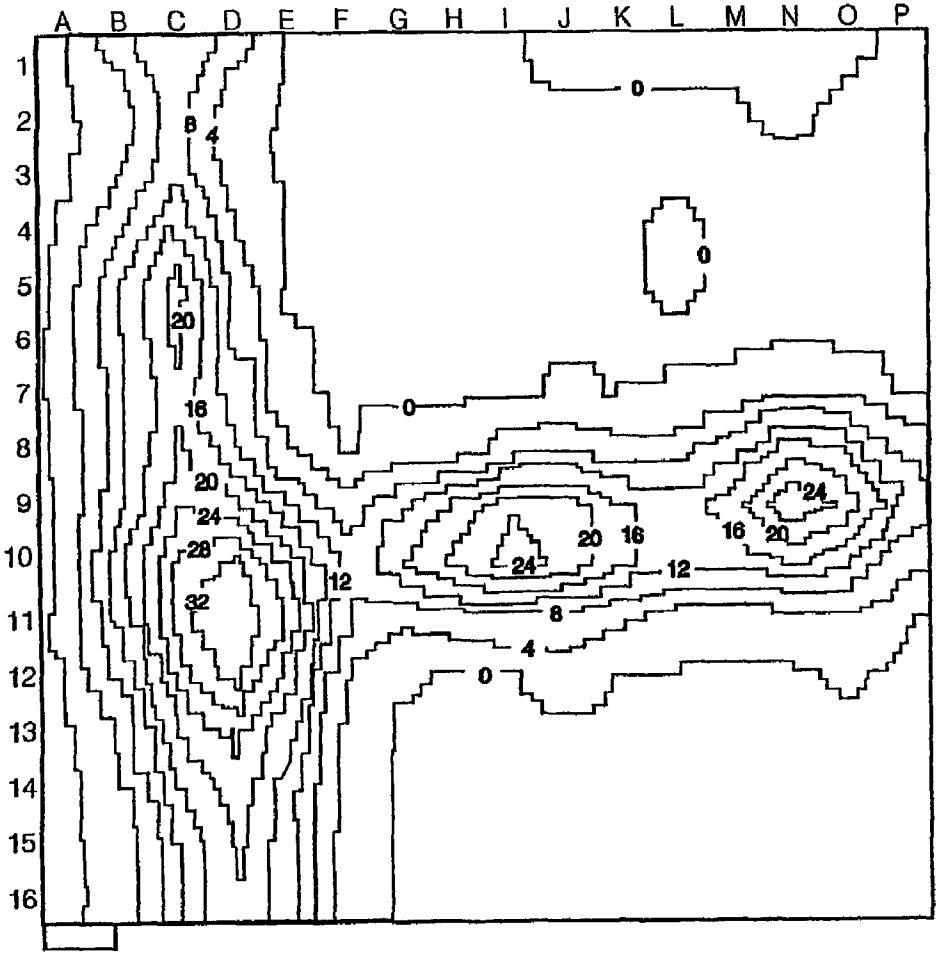
Figure 14G:
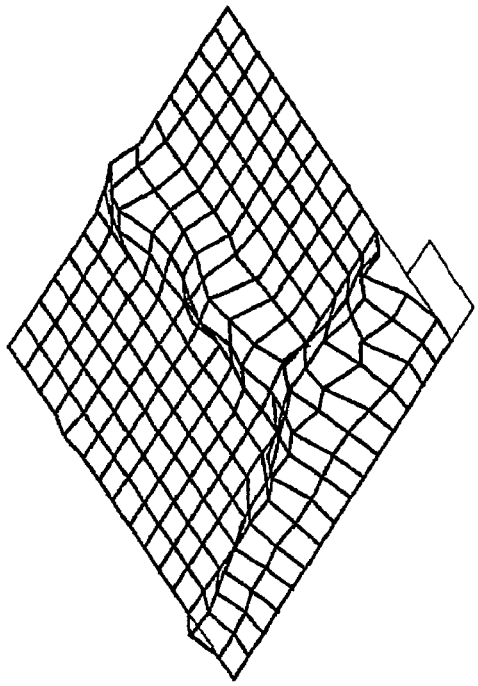
Figure 14G:
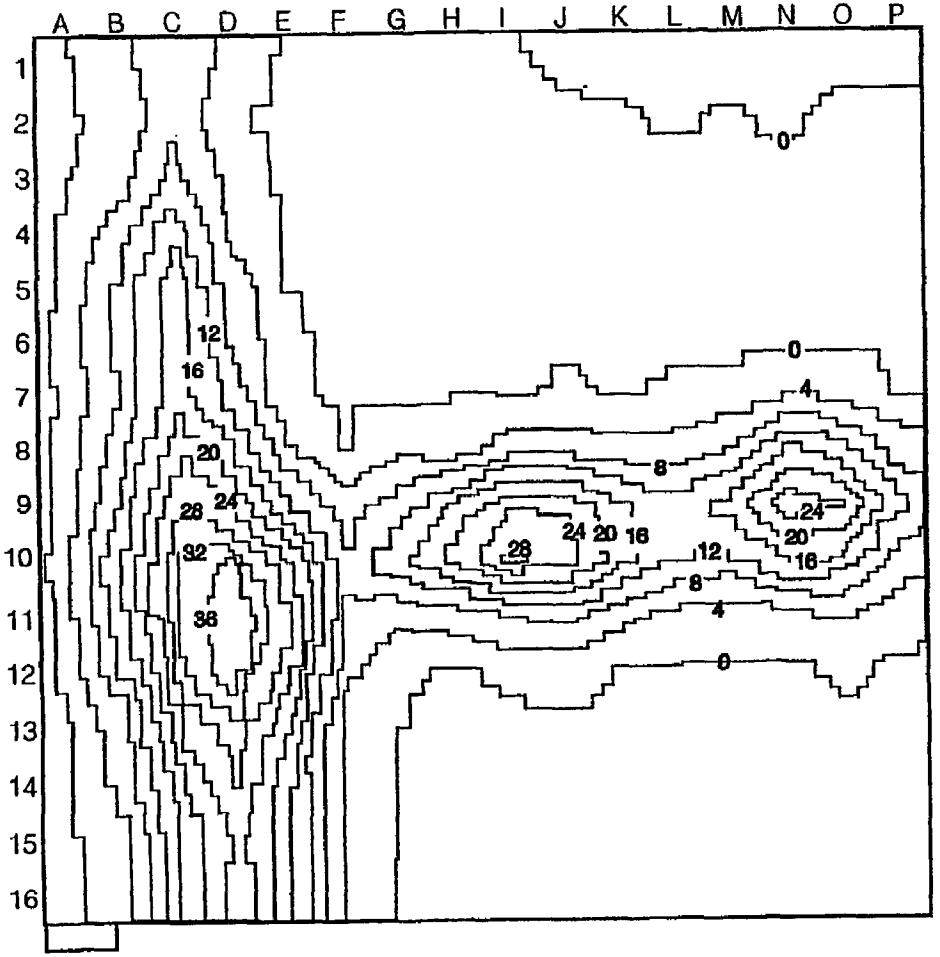
Figure 14H:
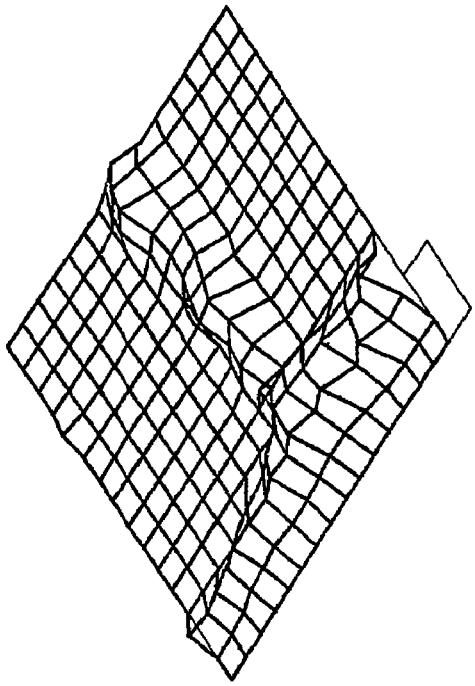
Figure 14H:
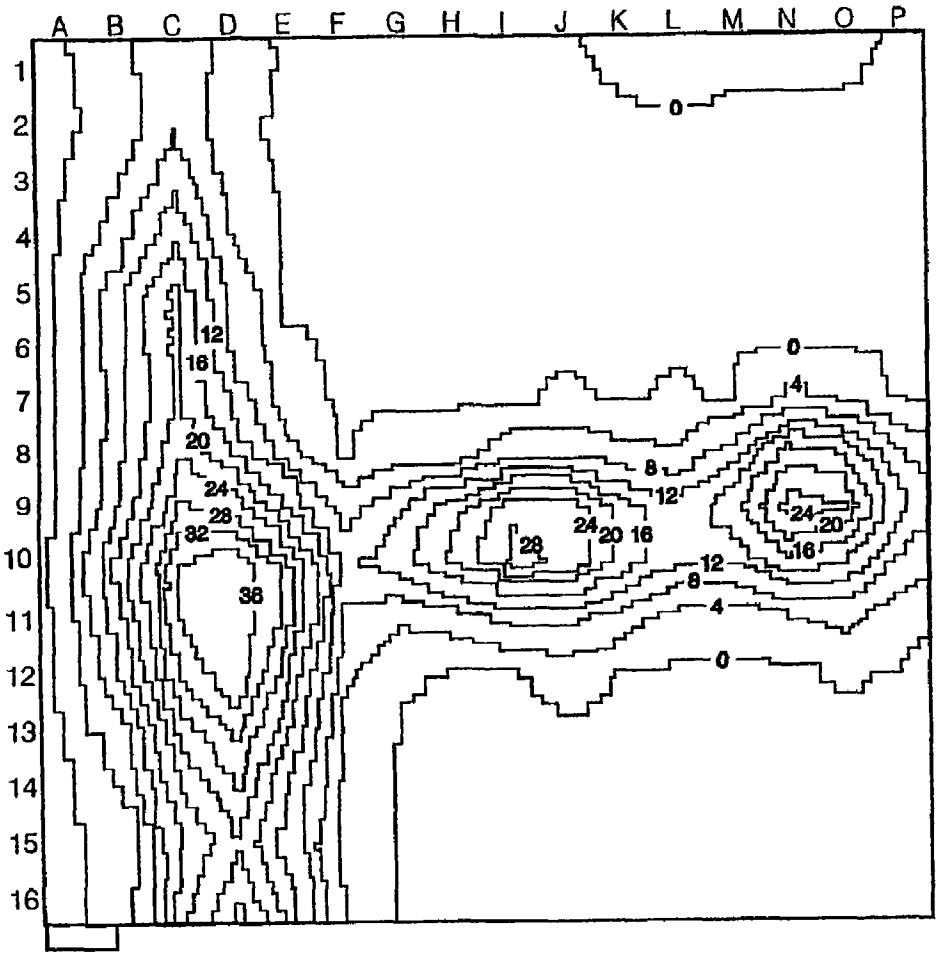

In FIGS. 14*f* to *h*, the subject's leg is strapped to the pad to a level which is comfortable for the subject. Indeed, the primary observation to be made is that the strapping is decidedly not tight and does not, of itself, greatly increase to any significant degree the level of pressure applied. This is evident from a comparison of FIGS. 14*a* and *e* in which the maximum pressure recorded in each case is about the same. FIG. 14*e* is likewise with no massage being effected, but FIGS. 14*f, g* and *h* are equivalent to FIGS. 14*b, c* and *d* in being set at massage levels 3, 4 and 5 respectively.

As well as a contour map of equal recorded pressures, each of FIGS. 14*a* to *h* also depict a relief image of the same information shown in the corresponding contour map.

It should be noted that when vibration is applied, the pressure recorded varies with the same amplitude of the vibrations. However, the measurements presented herein are representative of the average values applied.

TABLE VI

| Strap and Condition (Figure No.) | Sensors used | Average Pressure (mmHg) | Standard Deviation | Maximum Pressure (mmHg) | Area >20 mmHg pressure (units) |
|---|---|---|---|---|---|
| Loose, no massage (14a) | 39 | 11.5 | 6.93 | 30 | 88 |
| Loose, massage level 3 (14b) | 39 | 12.9 | 7.31 | 36 | 95 |
| Loose, massage level 4 (14c) | 39 | 15 | 8.41 | 32 | 109 |
| Loose, massage level 5 (14d) | 39 | 16 | 8.68 | 37 | 195 |
| Applied, no massage (14e) | 83 | 11.7 | 9.03 | 31 | 132 |
| Applied, massage level 3 (14f) | 97 | 13.1 | 9.99 | 35 | 193 |
| Applied, massage level 4 (14g) | 101 | 13.7 | 11.6 | 39 | 266 |
| Applied, massage level 5 (14h) | 95 | 15.2 | 12.2 | 42 | 282 |

The approximate area of the mat over which a pressure greater than 20 mmHg was recorded is given in Table VI, along with other variables recorded. From Table VI it can be seen that by applying the strap the pressure applied does not increase greatly, but the area over which it applies does, by 50% and more for a pressure of 20 mmHg in most conditions, and even more at the some level settings. The absolute level of pressure over which the increase applies is not especially the point, but it would seem to be by virtue of this increase that the effectiveness of the treatment is found to be so dramatically improved.

The invention claimed is:

1. A method of healing ulcers and of relieving the symptoms of lymphoedema by reducing swelling, said lymphoedema and said ulcers being of the human or animal body, which method comprises the step of subjecting the body in the area of the ulcer or lymphoedema to cycloidal mechanical vibrations with components in three orthogonal directions for an effective period of time;

wherein said cycloidal mechanical vibrations are provided by a treatment device that delivers mechanical vibrations at its surface in three orthogonal directions at a frequency in each orthogonal direction of between 15 and 75 Hz and with an amplitude in each orthogonal direction of between 0.1 and 0.5 mm and a pad connected to said treatment device;

said step further comprises applying pressure against said body area; and wherein the device is applied by pressure applying means to a limb of a patient suffering one or more of said conditions and so that, in use, the device delivers vibrations in the limb of the patient at a frequency of between 20 and 50 Hz, and with an RMS acceleration in the axial direction of the tibial or fibular bone of between 5 and 15 $ms^{-2}$, and in a radial plane with respect to the tibial or fibular bone with an RMS acceleration of between 2 and 5 $ms^{-2}$.

2. The method of claim 1, wherein said frequency being the same or different in each said three orthogonal directions, and said amplitude being the same or different in each said three orthogonal directions.

3. The method of claim 1, wherein said period is more than fifteen minutes, ideally about thirty minutes.

4. The method of claim 1, wherein the treatment is repeated three times a day.

5. The method of claim 1, wherein the device delivers vibrations in the leg of the patient at a frequency of about 30 Hz, and with an RMS acceleration in the axial direction of the tibial or fibulal bone of about 10 $ms^{-2}$, and in a radial plane with respect to the tibial or fibulal bone with an RMS acceleration of between 2 and 5 $ms^{-2}$.

6. The method of claim 1, wherein pressure is applied to said area of the body by the device subjecting the body to said cycloidal mechanical vibrations.

7. A method of healing ulcers and of relieving the symptoms of lymphoedema by reducing swelling, said lymphoedema and said ulcers being of the human or animal body, which method comprises the step of subjecting the body in the area of the ulcer or lymphoedema to cycloidal mechanical vibrations with components in three orthogonal directions for an effective period of time;

said cycloidal mechanical vibrations are provided by a treatment device that delivers mechanical vibrations at its surface in three orthogonal directions at a frequency in each orthogonal direction of between 15 and 75 HZ and with an amplitude in each orthogonal direction of between 0.1 and 0.5 mm and a pad connected to said treatment device;

said step further comprises applying pressure against said body area; and wherein pressure is applied to said area of the body by the device subjecting the body to said cycloidal mechanical vibrations, and wherein said pressure is applied by the pad through application of said pressure applying means such as to increase the area of the body subject to pressure in excess of 10 mm Hg by at least 25% of the area of the body subject to pressure in excess of 10 mm Hg without application of said pressure applying means.

8. A method of healing ulcers and of relieving the symptoms of lymphoedema by reducing swelling, said lymphoedema and said ulcers being of the human or animal body, which method comprises the step of subjecting the body in the area of the ulcer or lymphoedema to cycloidal mechanical vibrations concurrently with the application of pressure to the same area for an effective period of time;

wherein the cycloidal mechanical vibrations are provided by a treatment device that delivers mechanical vibrations at its surface in three orthogonal directions at a frequency in each orthogonal direction of between 15 and 75 HZ and with an amplitude in each orthogonal direction of between 0.1 and 0.5 mm; and wherein the treatment device delivers cycloidal vibrations in the limb of the patient at a frequency of between 20 and 50 Hz, and with an RMS acceleration in the axial direction of the tibial or fibulal bone of between 5 and 15 $ms^{-2}$, and in a radial plane with respect to the tibial or fibulal bone with an RMS acceleration of between 2 and 5 $ms^{-2}$.

9. The method of claim 8, wherein said vibrations have components in three orthogonal directions, said frequency being the same or different in each direction, and said amplitude being the same or different in each direction.

10. The method of claim 8, wherein said period is more than fifteen minutes, ideally about thirty minutes.

11. The method of claim 8, wherein the treatment is repeated three times a day.

12. The method of claim 8, wherein the treatment device delivers cycloidal vibrations in the leg of the patient at a frequency of about 30 Hz, and with an RMS acceleration in the axial direction of the tibial or fibulal bone of about 10 $ms^{-2}$, and in a radial plane with respect to the tibial or fibulal bone with an RMS acceleration of between 2 and 5 $ms^{-2}$.

13. The method of claim 8, wherein pressure is applied to said area of the body by the treatment device.

14. The method of claim 1, wherein pressure is applied to said area of the body by the device subjecting the body to said cycloidal mechanical vibrations, and wherein said pressure is applied by the pad through application of said pressure applying means such as to increase the area of the body subject to pressure in excess of 10 mm Hg by at least 50% of the area of the body subject to pressure in excess of 10 mm Hg without application of said pressure applying means.

15. A method of prophylactic treatment of deep vein thrombosis (DVT) in a limb of the human or animal body, which method comprises the step of subjecting the limb to cycloidal mechanical vibrations with components in three orthogonal directions for an effective period of time, said vibrations having a frequency of between 15 and 75 Hz, and an amplitude of between 0.1 and 0.5 mm, wherein:

said cycloidal mechanical vibrations are provided by a treatment device that delivers mechanical vibrations at its surface in three orthogonal directions at a frequency in each orthogonal direction of between 15 and 75 HZ and with an amplitude in each orthogonal direction of between 0.1 and 0.5 mm and a pad connected to said treatment device; and said step further comprises applying pressure against said limb, and wherein the pressure is applied by pressure applying means to the limb so that, in use, the device delivers vibrations in the limb of the patient at a frequency of between 15 and 75 Hz, and with an RMS acceleration in the axial direction of the tibial or fibulal bone of between 5 and 15 $ms^{-2}$, and in a radial plane with respect to the tibial or fibulal bone with an RMS acceleration of between 2 and 5 $ms^{-2}$.

16. The method of claim 15, wherein the device delivers vibrations in the leg of the patient at a frequency of about 30 Hz, and with an RMS acceleration in the axial direction of the tibial or fibulal bone-of about 10 $ms^{-2}$, and in a radial plane with respect to the tibial or fibulal bone with an RMS acceleration of between 2 and 5 $ms^{-2}$.

17. The method of claim 15, wherein said pressure is applied such as to increase the area of the body subject to pressure in excess of 10 mm Hg by at least 25% of the area of the body subject to pressure in excess of 10 mm Hg without application of said pressure applying means.

18. The method of claim 15, wherein said pressure is applied such as to increase the area of the body subject to pressure in excess of 10 mm Hg by at least 50% of the area of the body subject to pressure in excess of 10 mm Hg without application of said pressure applying means.

19. The method of claim 1, wherein pressure is applied to said area of the body by the device subjecting the body to said cycloidal mechanical vibrations, and wherein said pressure is applied by the pad through application of said pressure applying means such as to increase the area of the body subject to pressure in excess of 10 mm Hg by at least 25% of the area of the body subject to pressure in excess of 10 mm Hg without application of said pressure applying means.

20. The method of claim 7, wherein pressure is applied to said area of the body by the device subjecting the body to said cycloidal mechanical vibrations, and wherein said pressure is applied by the pad through application of said pressure applying means such as to increase the area of the body subject to pressure in excess of 10 mm Hg by at least 50% of the area of the body subject to pressure in excess of 10 mm Hg without application of said pressure applying means.

21. The method of claim 7, wherein said vibrations have components in three orthogonal directions, said frequency being the same or different in each direction, and said amplitude being the same or different in each direction.

22. The method of claim 7, wherein the device delivers vibrations in the leg of the patient at a frequency of about 30 Hz, and with an RMS acceleration in the axial direction of the tibial or fibulal bone of about 10 ms−2, and in a radial plane with respect to the tibial or fibulal bone with an RMS acceleration of between 2 and 5 ms−2.

* * * * *

UNITED STATES PATENT AND TRADEMARK OFFICE

CERTIFICATE OF CORRECTION

PATENT NO. : 7,615,018 B2
APPLICATION NO. : 10/643824
DATED : November 10, 2009
INVENTOR(S) : Nelson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 827 days.

Signed and Sealed this

Nineteenth Day of October, 2010

David J. Kappos

David J. Kappos
*Director of the United States Patent and Trademark Office*